US010962199B2

(12) United States Patent
Tudorica et al.

(10) Patent No.: US 10,962,199 B2
(45) Date of Patent: Mar. 30, 2021

(54) SOLID STATE LIGHTING COMPONENTS

(71) Applicant: Cree, Inc., Durham, NC (US)

(72) Inventors: Florin A. Tudorica, Chapel Hill, NC (US); Christopher P. Hussell, Cary, NC (US); John Wesley Durkee, Raleigh, NC (US); Peter Scott Andrews, Durham, NC (US); Mark Cash, Raleigh, NC (US); David Randolph, Rougemont, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 16/901,624

(22) Filed: Jun. 15, 2020

(65) Prior Publication Data

US 2020/0309347 A1 Oct. 1, 2020

Related U.S. Application Data

(63) Continuation of application No. 15/143,261, filed on Apr. 29, 2016, now Pat. No. 10,683,971.

(Continued)

(51) Int. Cl.
*F21V 9/30* (2018.01)
*F21K 9/62* (2016.01)

(Continued)

(52) U.S. Cl.
CPC ..... *F21V 9/30* (2018.02); *F21K 9/60* (2016.08); *F21K 9/62* (2016.08); *F21K 9/66* (2016.08);

(Continued)

(58) Field of Classification Search
CPC ..... F21V 9/30; F21V 19/506; F21V 19/76; F21V 19/777; F21V 19/83; F21V 19/89;

(Continued)

(56) References Cited

U.S. PATENT DOCUMENTS 4,918,497 A 4/1990 Edmond
4,966,862 A 10/1990 Edmond (Continued)

FOREIGN PATENT DOCUMENTS

WO WO 2010/113098 A1 10/2010
WO WO 2012/071598 A2 6/2012

OTHER PUBLICATIONS

"IES Method for Evaluating Light Source Color Rendition," The Illuminating Engineering Society (IES) Technical Memorandum, TM-30-15, May 18, 2015.

(Continued)

*Primary Examiner* — Bryon T Gyllstrom

(74) *Attorney, Agent, or Firm* — Jenkins, Wilson, Taylor & Hunt, P.A.

(57) ABSTRACT

Solid state lighting components are provided with improved color rendering, improved color uniformity, and improved directional lighting, and that are suitable for use in high output lighting applications and can be used in place of CDMH bulb lighting. Exemplary solid state lighting components include a substrate comprising a light emitter surface and or more light emitters disposed on and/or over the light emitter surface. Exemplary components include a light directing optic and/or a diffusing optic for mixing light. The light directing optic may be disposed at least partially around a perimeter of the light emitter surface. The diffusing optic may be disposed between portions of the light directing optic and spaced apart from the light emitter surface.

24 Claims, 21 Drawing Sheets

Related U.S. Application Data

(60) Provisional application No. 62/155,349, filed on Apr. 30, 2015.

(51) Int. Cl.

| | |
|---|---|
| ***F21V 13/02*** | (2006.01) |
| ***F21K 9/60*** | (2016.01) |
| ***F21V 29/506*** | (2015.01) |
| ***F21V 23/00*** | (2015.01) |
| ***F21V 7/30*** | (2018.01) |
| ***F21V 29/76*** | (2015.01) |
| ***F21V 29/77*** | (2015.01) |
| ***F21V 29/83*** | (2015.01) |
| ***F21V 29/89*** | (2015.01) |
| ***F21K 9/66*** | (2016.01) |
| ***F21K 9/68*** | (2016.01) |
| ***F21V 3/00*** | (2015.01) |
| ***F21V 7/00*** | (2006.01) |
| ***F21V 17/14*** | (2006.01) |
| ***F21Y 101/00*** | (2016.01) |
| ***F21Y 115/30*** | (2016.01) |
| ***F21Y 115/10*** | (2016.01) |
| ***F21Y 115/15*** | (2016.01) |

(52) U.S. Cl.
CPC ..... *F21K 9/68* (2016.08); *F21V 3/00* (2013.01); *F21V 7/00* (2013.01); *F21V 7/30* (2018.02); *F21V 13/02* (2013.01); *F21V 23/003* (2013.01); *F21V 23/005* (2013.01); *F21V 23/008* (2013.01); *F21V 29/506* (2015.01); *F21V 29/76* (2015.01); *F21V 29/777* (2015.01); *F21V 29/83* (2015.01); *F21V 29/89* (2015.01); *F21V 17/14* (2013.01); *F21Y 2101/00* (2013.01); *F21Y 2115/10* (2016.08); *F21Y 2115/15* (2016.08); *F21Y 2115/30* (2016.08)

(58) Field of Classification Search
CPC ..... F21V 7/30; F21V 3/00; F21V 7/00; F21V 13/02; F21V 23/003; F21V 23/005; F21V 23/008
USPC ..... 362/231
See application file for complete search history.

(56) References Cited

U.S. PATENT DOCUMENTS 5,027,168 A 6/1991 Edmond
5,210,051 A 5/1993 Carter, Jr.
5,338,944 A 8/1994 Edmond et al.
5,359,345 A 10/1994 Hunter
5,393,993 A 2/1995 Edmond et al.
5,416,342 A 5/1995 Edmond et al.
5,523,589 A 6/1996 Edmond et al.
5,604,135 A 2/1997 Edmond et al.
5,631,190 A 5/1997 Negley
5,739,554 A 4/1998 Edmond et al.
5,912,477 A 6/1999 Negley
6,086,227 A 7/2000 O'Connell et al.
6,120,600 A 9/2000 Edmond et al.
6,187,606 B1 2/2001 Edmond et al.
6,200,002 B1 3/2001 Marshall et al.
6,201,262 B1 3/2001 Edmond et al.
6,511,209 B1 1/2003 Chiang
6,515,313 B1 2/2003 Ibbetson et al.
6,600,175 B1 7/2003 Baretz et al.
6,791,119 B2 9/2004 Slater, Jr. et al.
6,853,010 B2 2/2005 Slater, Jr. et al.
6,906,352 B2 6/2005 Edmond et al.
6,953,261 B1 10/2005 Jiao et al.
6,958,497 B2 10/2005 Emerson et al.
7,095,056 B2 8/2006 Vitta et al.
7,213,940 B1 5/2007 Van De Ven et al.
7,312,474 B2 12/2007 Emerson et al.
7,382,423 B2 * 6/2008 Chang ..... G02F 1/133608 349/58
7,446,345 B2 11/2008 Emerson et al.
7,456,499 B2 11/2008 Loh et al.
D582,866 S 12/2008 Edmond et al.
D594,827 S 6/2009 Loh et al.
7,564,180 B2 7/2009 Brandes
7,655,957 B2 2/2010 Loh et al.
7,692,182 B2 4/2010 Bergmann et al.
D615,504 S 5/2010 Keller et al.
D623,607 S 9/2010 Andrews et al.
7,802,901 B2 9/2010 McMillan
7,821,023 B2 10/2010 Yuan et al.
D635,527 S 4/2011 Hussell et al.
7,943,945 B2 5/2011 Baretz et al.
7,952,544 B2 5/2011 Roberts
7,960,819 B2 6/2011 Loh et al.
D641,719 S 7/2011 Hussell et al.
7,999,283 B2 8/2011 Chakraborty et al.
8,018,135 B2 9/2011 Van De Ven et al.
8,038,321 B1 10/2011 Franck et al.
8,038,327 B1 10/2011 Franck et al.
8,044,418 B2 10/2011 Loh et al.
D648,686 S 11/2011 Hussell et al.
8,057,070 B2 11/2011 Negley et al.
8,125,137 B2 2/2012 Medendorp et al.
D656,906 S 4/2012 Leung
D659,657 S 5/2012 Hussell et al.
8,217,412 B2 7/2012 Yuan et al.
8,220,970 B1 7/2012 Khazi et al.
8,264,138 B2 9/2012 Negley et al.
D671,661 S 11/2012 Leung
8,324,648 B2 * 12/2012 Chien ..... H01L 33/58 257/98
8,337,071 B2 12/2012 Negley et al.
8,563,339 B2 10/2013 Tarsa et al.
8,602,579 B2 12/2013 Van De Ven et al.
8,622,582 B2 1/2014 Loh
8,659,034 B2 2/2014 Baretz et al.
8,669,573 B2 3/2014 Medendorp, Jr.
8,729,589 B2 5/2014 Hussell et al.
D709,464 S 7/2014 Abare et al.
8,777,449 B2 7/2014 Van De Ven et al.
D711,840 S 8/2014 Lowes et al.
D711,841 S 8/2014 Britt et al.
8,866,410 B2 10/2014 Negley et al.
8,970,131 B2 3/2015 Brandes et al.
8,992,044 B2 * 3/2015 Moeck ..... H01L 33/50 362/247
8,998,444 B2 4/2015 Roberts et al.
9,024,349 B2 5/2015 Chitnis et al.
9,131,561 B2 9/2015 Athalye
9,159,888 B2 10/2015 Chitnis et al.
9,275,979 B2 3/2016 Tong et al.
9,277,605 B2 3/2016 Ni
9,414,454 B2 8/2016 Brandes et al.
9,425,172 B2 8/2016 Van De Ven et al.
9,793,247 B2 10/2017 Yuan et al.
2003/0086268 A1 * 5/2003 Kovacik ..... F21L 14/026 362/287
2006/0221272 A1 10/2006 Negley et al.
2007/0104828 A1 5/2007 Fornaguera
2007/0268694 A1 * 11/2007 Bailey ..... H01L 33/54 362/231
2007/0268706 A1 11/2007 Wagener et al.
2008/0055912 A1 3/2008 Kittelmann et al.
2008/0093530 A1 * 4/2008 Hoelen ..... G01J 3/505 250/201.1
2008/0186704 A1 8/2008 Chou et al.
2009/0050908 A1 2/2009 Yuan et al.
2009/0244903 A1 * 10/2009 Wong ..... H01L 33/60 362/308
2010/0172120 A1 7/2010 Wegh et al.
2010/0244700 A1 9/2010 Chong et al.
2010/0254115 A1 10/2010 Wegh et al.

(56) References Cited

U.S. PATENT DOCUMENTS

| | | | | |
|---|---|---|---|---|
| 2010/0259919 | A1* | 10/2010 | Khazi | F21V 17/16 362/84 |
| 2011/0068702 | A1 | 3/2011 | Van de Ven et al. | |
| 2011/0176316 | A1 | 7/2011 | Phipps et al. | |
| 2012/0051068 | A1 | 3/2012 | Pelton et al. | |
| 2012/0327655 | A1 | 12/2012 | Li | |
| 2013/0016509 | A1 | 1/2013 | Van de Ven | |
| 2014/0367713 | A1 | 12/2014 | Zhang et al. | |
| 2015/0009682 | A1 | 1/2015 | Clough | |

OTHER PUBLICATIONS

U.S. Appl. No. 62/262,414, titled "Solid State Light Fixtures Suitable for High Temperature Operation Having Separate Blue-Shifted-Yellow/Green and Blue-Shifted-Red Emitters" dated Dec. 3, 2015.

International Search Report and Written Opinion for Application No. PCT/US2016/030211 dated Oct. 10, 2016.

Notice of Publication for Application No. PCT/US2016/030211 dated Nov. 3, 2016.

Non-Final Office Action for U.S. Appl. No. 15/143,261 dated Oct. 19, 2018.

Final Office Action for U.S. Appl. No. 15/143,261 dated Apr. 18, 2019.

Advisory Action for U.S. Appl. No. 15/143,261 dated Jul. 31, 2019.

Non-Final Office Action for U.S. Appl. No. 15/143,261 dated Oct. 4, 2019.

European Office Action for Application No. 16724776.6 dated Nov. 13, 2019.

Notice of Allowance for U.S. Appl. No. 15/143,261 dated Feb. 12, 2020.

European Office Action for Application No. 16724776.6 dated Aug. 11, 2020.

* cited by examiner

SOLID STATE LIGHTING COMPONENTS

CROSS-REFERENCE TO RELATED APPLICATIONS

The present application is a continuation of and claims priority to U.S. patent application Ser. No. 15/143,261 filed on Apr. 29, 2016, which claims priority to U.S. Provisional Patent Application Ser. No. 62/155,349, filed on Apr. 30, 2015, the disclosures of which are incorporated herein by reference in their entirety.

TECHNICAL FIELD

The present subject matter relates generally to lighting components and, more particularly, to solid state lighting components.

BACKGROUND

Solid state light emitters are used in a variety of lighting components in, for example, commercial, automotive, and consumer lighting applications. Solid state emitters can comprise, for example, one or more unpackaged light emitting diode (LED) chips, and/or one or more packaged LED chips, wherein the chips can comprise inorganic and/or organic LED chips (OLEDs). Solid state emitters generate light via the recombination of electronic carriers (electrons and holes) in a light emitting layer or region of an LED chip. LED chips have significantly longer lifetimes and a greater luminous efficiency than conventional light sources. LED chips are also environmentally friendly unlike conventional metal halide bulbs. However, as LED chips are narrow-bandwidth light emitters, it can be challenging to simultaneously provide good color rendering and uniformity in combination with high luminous efficacy while maintaining and maximizing brightness and efficiency.

Lighting designers, manufacturers, and/or consumers have expressed the need for an alternative to and/or a replacement for costly and environmentally toxic ceramic discharge metal halide (CDMH) bulbs. CDMH bulbs also disadvantageously require a warm up time before emitting light, which is bothersome to consumers.

Challenges exist in incorporating solid state lighting sources into high output fixtures such as spot light, high-bay, and/or low-bay lighting applications, for example as found in retail locations where CDMH lighting has been used. Conventional solid state components utilize large form-factor diffusers that are placed either close in proximity to and/or directly on the light emitting chips, which results in color separation, color blotches, and/or color rings. Challenges exist in obtaining a uniform color and light output from solid state lighting fixtures.

Accordingly, room for improvement exists in providing solid state lighting components that exhibit improved color rendering, improved color uniformity, and improved directional lighting, and that are also suitable for use in high output lighting applications and can be used in place of CDMH bulb lighting.

SUMMARY

Solid state lighting components and systems are described herein. An exemplary solid state lighting component comprises a substrate, one or more light emitters disposed over the substrate, a light direction optic, and a diffusing optic. The surface area of the substrate that is occupied by the one or more light emitters defines a light emitter surface. The light directing optic comprising a reflective surface disposed around a perimeter of the light emitter surface. The diffusing optic is disposed between portions of the reflective surface and over the one or more light emitters, and a portion of the diffusing optic is positioned a distance away from the light emitter surface, in some aspects for improving color rendering.

In further embodiments, a solid state lighting spotlight is provided with a substrate, one or more light emitters disposed on or over the substrate, a light directing optic, a light diffusing optic, and a spacer. The light directing optic is disposed around the light emitter surface and the light diffusing optic is disposed between portions of the light directing optic and the light emitter surface. The spacer maintains at least a portion of the diffusing optic a distance away from the light emitter surface, and the distance is greater than a radius of the light emitter surface, in some aspects for improving color rendering.

In further embodiments, a solid state lighting component comprises a substrate, at least two light emitters disposed over the substrate, a diffusing optic, and a light directing optic. The at least two light emitters are disposed over the substrate. A first light emitter is configured to emit a first color of light and a second light emitter is configured to emit a second color of light. The diffusing optic is disposed over the at least two light emitters, and a portion of the diffusing optic is positioned a distance away from a light emitter surface defined by the surface area occupied by the at least two light emitters. The light directing optic is configured to receive and reflect light that passes through the diffusing optic. The solid state lighting component is configured to provide a narrow or centered type light beam.

Other aspects, features and embodiments of the subject matter will be more fully apparent from the ensuing disclosure and appended claims. Components and systems provided herein comprise improved (reduced) cost, improved thermal management capabilities, improved efficiency, smaller footprints, improved color mixing, and improved brightness. These and other objects are achieved, at least in whole or in part, according to the subject matter disclosed herein.

BRIEF DESCRIPTION OF THE DRAWINGS

A full and enabling disclosure of the present subject matter is set forth more particularly in the remainder of the specification, including reference to the accompanying figures, relating to one or more embodiments, in which.

DETAILED DESCRIPTION

Figure 1A:
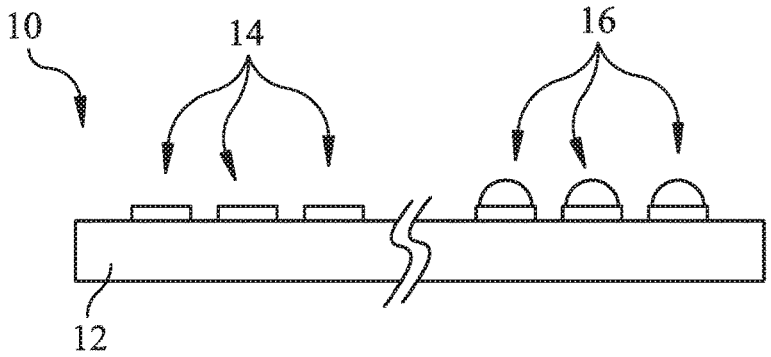
FIGS. 1A and 1B are side and plan views of solid state light emitter substrates or boards according to some aspects.

The subject matter disclosed herein including in the accompanying drawings relates in certain aspects to improved solid state lighting components such as for use in high brightness applications having improved color rendering, uniformity, tighter central spot lighting, and improved overall lighting. Notably, solid state components and systems herein can be provided in high-output (e.g., regarding intensity or brightness) retail and industrial lighting applications such as spotlighting applications, high-bay lighting, and/or low-bay lighting applications for replacing costly ceramic discharge metal halide (CDMH) bulbs.

In some aspects, solid state lighting components described herein can comprise various dimensional aspects (e.g., regarding placement of optics and/or diffusing elements), color combinations, and/or optical elements for providing solid state lighting components having improved efficiency, improved color mixing, tighter color uniformity, and/or improved color rendering. Components disclosed herein advantageously cost less, are more efficient, are naturally white, vivid, last longer, have improved color mixing, and/or are brighter than other solutions targeting CDMH replacement.

Notably, solid state lighting components herein provide a powerful, narrow or centered light beam comprising a color rendering index (CRI) of approximately 80 CRI or more is provided that utilizes at least two LEDs (LED chips or packages) of different colors, and matches the light output of a metal-halide bulb.

Unless otherwise defined, terms used herein should be construed to have the same meaning as commonly understood by one of ordinary skill in the art to which this subject matter belongs. It will be further understood that terms used herein should be interpreted as having a meaning that is consistent with the respective meaning in the context of this specification and the relevant art, and should not be interpreted in an idealized or overly formal sense unless expressly so defined herein.

Aspects of the subject matter are described herein with reference to sectional, perspective, elevation, and/or plan view illustrations that are schematic illustrations of idealized aspects of the subject matter. Variations from the shapes of the illustrations as a result, for example, of manufacturing techniques and/or tolerances, are to be expected, such that aspects of the subject matter should not be construed as limited to particular shapes illustrated herein. This subject matter can be embodied in different forms and should not be construed as limited to the specific aspects or embodiments set forth herein. In the drawings, the size and relative sizes of layers and regions can be exaggerated for clarity.

Unless the absence of one or more elements is specifically recited, the terms "comprising," "including," and "having" as used herein should be interpreted as open-ended terms that do not preclude the presence of one or more elements. Like numbers refer to like elements throughout this description.

It will be understood that when an element such as a layer, region, or substrate is referred to as being "on" another element, it can be directly on the other element or intervening elements can be present. Moreover, relative terms such as "on", "above", "upper", "top", "lower", or "bottom" are used herein to describe one structure's or portion's relationship to another structure or portion as illustrated in the figures. It will be understood that relative terms such as "on", "above", "upper", "top", "lower" or "bottom" are intended to encompass different orientations of the object in addition to the orientation depicted in the figures. For example, if the object in the figures is turned over, structure or portion described as "above" other structures or portions would now be oriented "below" the other structures or portions.

The terms "electrically activated emitter(s)" and/or "emitter(s)" as used herein refer to any device capable of producing visible or near visible (e.g., from infrared to ultraviolet) wavelength radiation, including but not limited to, xenon lamps, mercury lamps, sodium lamps, incandescent lamps, and solid state emitters, including LEDs or LED chips, organic light emitting diodes (OLEDs), and lasers.

The terms "emitter(s)", "solid state emitter(s)", and/or "light emitter(s)" refer to an LED chip, an LED package, a laser diode, an organic LED chip, and/or any other semiconductor device preferably arranged as a semiconductor chip that comprises one or more semiconductor layers, which can comprise silicon, silicon carbide, gallium nitride and/or other semiconductor materials, a substrate which can comprise sapphire, silicon, silicon carbide and/or other microelectronic substrates, and one or more contact layers which can comprise metal and/or other conductive materials.

The terms "centered", "central" or "narrow" for describing a light beam as used herein refers to the beam angle. The beam angle is the degree of width that light emits from a light source. More particularly, the beam angle is the angle between the opposing points on the beam axis where the intensity drops to 50% of its maximum illumination. A variety of descriptions can be used for the beam angle resulting from the LED light, such as a wide beam angle for what might be referred to as a flood light, and a narrow beam angle for what might be referred to as a spot light. Regardless of any such designations, the subject matter disclosed herein can be used with a variety of beam angles for LED lighting as further described herein.

The terms "groups", "segments", "strings", and "sets" as used herein are synonymous terms. As used herein, these terms generally describe how multiple LED chips are electrically connected in series, in parallel, or in mixed series/parallel configurations among mutually exclusive groups/segments/sets. The segments of LED chips can be configured in a number of different ways and can have circuits of varying functionality associated therewith (e.g. driver circuits, rectifying circuits, current limiting circuits, shunts, bypass circuits, etc.), as discussed, for example, in commonly assigned and co-pending U.S. patent application Ser. No. 12/566,195, filed on September 24, 8,72009, U.S. patent application Ser. No. 13/769,273, filed on Feb. 15, 2013, U.S. patent application Ser. No. 13/769,277 filed on Feb. 15, 2013, U.S. patent application Ser. No. 13/235,103, filed on Sep. 16, 2011, U.S. patent application Ser. No. 13/235,127, filed on Sep. 16, 2011, and U.S. Pat. No. 8,729,589, which issued on May 20, 2014, the disclosure of each of which is hereby incorporated by reference herein, in the entirety.

Components and systems herein can utilize any color of chip. For example and without limitation, red chips, blue chips, and/or green chips or any other color chip can be used. In some aspects, blue chips for use in blue shifted yellow (BSY) devices can target different bins as set forth in Table 1 of commonly owned, assigned, and co-pending U.S. Patent Application Serial No. 2009/0160363, the disclosure of which is incorporated by reference herein in the entirety. Components and systems herein can utilize ultraviolet (UV) chips, cyan chips, blue chips, green chips, red chips, amber chips, and/or infrared chips. As disclosed in commonly owned, assigned, and co-pending U.S. Provisional Patent Application Ser. No. 62/262,414A, filed on Dec. 3, 2015 and entitled "SOLID STATE LIGHT FIXTURES SUITABLE FOR HIGH TEMPERATURE OPERATION HAVING SEPARATE BLUE-SHIFTED-YELLOW/GREEN AND BLUE-SHIFTED-RED EMITTERS", the entire disclosure of which is incorporated by reference herein, a plurality of blue-shifted-yellow and/or blue-shifted-green LEDs as well as a plurality of blue-shifted-red LEDs may be used. Herein, the term "blue-shifted-yellow LED" refers to an LED that emits light in the blue color range that has an associated recipient luminophoric medium that includes phosphor(s) that receives the blue light emitted by the blue LED and in response thereto emits light having a peak wavelength in the yellow color range. A common example of a blue-shifted-yellow LED is a GaN-based blue LED that is coated or sprayed with a recipient luminophoric medium that includes a YAG:Ce phosphor. Similarly, as used herein the term "blue-shifted-green LED" refers to an LED that emits light in the blue color range that has an associated recipient luminophoric medium that includes phosphor(s) that receives the blue light emitted by the blue LED and in response thereto emits light having a peak wavelength in the green color range, and the term "blue-shifted-red LED" refers to an LED that emits light in the blue color range that has an associated recipient luminophoric medium that includes phosphor(s) that receives the blue light emitted by the blue LED and in response thereto emits light having a peak wavelength in the red color range. In some cases, a recipient luminophoric medium that is associated with a blue LED may include, for example, both green and yellow phosphors. In such a case, if the peak wavelength of the combined light output by the green and yellow phosphors is in the yellow color range, the LED is considered to be a blue-shifted-yellow LED, whereas if the peak wavelength of the combined light output by the green and yellow phosphors is in the green color range, the LED is considered to be a blue-shifted-green LED. In accordance with the disclosure herein, at least one or more LED(s) of each of the different colors can be used. In some aspects, only two LEDS can be used where each LED is of a different color, such as for example at least one blue shifted yellow (BSY) and at least one blue shifted red (BSR).

Also, commonly owned and assigned U.S. Pat. No. 8,998,444, entitled "SOLID STATE LIGHTING DEVICES INCLUDING LIGHT MIXTURES", is incorporated by reference herein in its entirety. As set forth in that patent, the disclosure herein can in some embodiments use blue shifted red (BSR) emitting phosphor based LEDs and green-yellow, BSY or green emitters provided as physically separate emitters on a board. A blue shifted red emitting phosphor based LED can include, for example, a blue LED chip coated or otherwise combined with a red phosphor. The light emitted by a blue LED chip coated or otherwise combined with red phosphor can combine, for example, with green light emitted by a green LED chip or green-yellow light (e.g., Blue Shifted Yellow, or BSY) to produce warm white light having a high CRI (e.g., greater than 95) with a high luminous efficacy (lm/W). Such a combination can be particularly useful, as InGaN-based green LEDs can have relatively high efficiency. Furthermore, the human eye is most sensitive to light in the green portion of the spectrum. Thus, although some efficiency can be lost due to the use of a red phosphor, the overall efficiency of the pair of LEDs can increase due to the increased efficiency of a green LED or a BSY LED.

Additionally, commonly owned, assigned and co-pending U.S. Patent Application Serial No. 2011/0228514, entitled "ENHANCED COLOR RENDERING INDEX EMITTER THROUGH PHOSPHOR SEPARATION", filed Sep. 22, 2011, is incorporated by reference herein in its entirety. Chips or LEDs for color mixing in accordance with the disclosure herein can also be set forth in that patent. For example, a first emitter or package can have one color phosphor, such as blue or green, and a second emitter or package can have a different color phosphor, such as red phosphor. The emission from the packages can be directional such that nearly all of the light from each of the emitters does not fall on the other. As a result, the light from the one color phosphor will not pass into the other color phosphor where it risks being re-absorbed. This type of lateral separation provides an even greater reduction in the amount of light that can be re-absorbed, and thereby further reduces the negative impact that re-absorption can have on a lamps CRI.

The term "substrate" as used herein in connection with lighting components refers to a mounting member or element on which, in which, or over which, multiple solid state light emitters (e.g., LED chips) can be arranged, supported, and/or mounted.

Exemplary substrates useful with lighting componentsas described herein comprise printed circuit boards (PCBs) and/or related components (e.g., including but not limited to metal core printed circuit boards (MCPCBs), submounts, flexible circuit boards, dielectric laminates, ceramic based substrates, and the like) or ceramic boards having FR4 and/or electrical traces arranged on one or multiple surfaces thereof, high reflectivity ceramics (e.g., Alumina) support panels, and/or mounting elements of various materials and conformations arranged to receive, support, and/or conduct electrical power to solid state emitters.

Electrical components, such as electrical traces or contacts described herein provide electrical power to the emitters for electrically activating and illuminating the emitters. Electrical traces or portions thereof, can be visible and/or covered via a reflective covering, such as a solder mask material or other suitable reflector. In some aspects, a single, unitary substrate or submount can be used to support multiple groups of solid state light emitters in addition to at least some other circuits and/or circuit elements, such as a power or current driving components and/or current switching components.

Solid state lighting component according to aspects of the subject matter herein can comprise III-V nitride (e.g., gallium nitride) based LED chips or laser chips fabricated on a silicon, silicon carbide, sapphire, or III-V nitride growth substrate, including (for example) chips manufactured and sold by Cree, Inc. of Durham, N.C. Such LED chips and/or lasers can be configured to operate such that light emission occurs through the substrate in a so-called "flip chip" orientation. Such LED and/or laser chips can also be devoid of growth substrates (e.g., following growth substrate removal).

LED chips useable with lighting components as disclosed herein can comprise horizontally structured junctions (with both electrical contacts on a same side of the LED chip) and/or vertically structured junctions (with electrical contacts on opposite sides of the LED chip). A horizontally structured chip (with or without the growth substrate), for example, can be flip chip bonded (e.g., using solder) to a carrier substrate or printed circuit board (PCB), or wire bonded. A vertically structured chip (without or without the growth substrate) can have a first terminal solder bonded to a carrier substrate, mounting pad, or printed circuit board (PCB), and have a second terminal wire bonded to the carrier substrate, electrical element, or PCB.

Electrically activated light emitters, such as solid state emitters, can be used individually or in groups to emit one or more beams of light to stimulate emissions of one or more lumiphoric materials (e.g., phosphors, scintillators, lumiphoric inks, quantum dots), and generate light at one or more peak wavelengths, or of at least one desired perceived color (including combinations of colors that can be perceived as white). Inclusion of lumiphoric (also called 'luminescent') materials in lighting components as described herein can be accomplished by an application of a direct coating of the material on lumiphor support elements or lumiphor support surfaces (e.g., by powder coating, inkjet printing, or the like), adding such materials to lenses, and/or by embedding or dispersing such materials within lumiphor support elements or surfaces. Methods for fabricating LED chips having a planarized coating of phosphor integrated therewith are described by way of example in U.S. Patent Application Publication No. 2008/0179611, filed on Sep. 7, 2007, to Chitnis et al., the disclosure of which is hereby incorporated by reference herein in the entirety.

Other materials, such as light scattering elements (e.g., particles) and/or index matching materials can be associated with a lumiphoric material-containing element or surface. Components as disclosed herein can comprise LED chips of different colors, one or more of which can be white emitting (e.g., including at least one LED chip with one or more lumiphoric materials).

In some aspects, one or more short wavelength solid state emitters (e.g., blue and/or cyan LED chips) can be used to stimulate emissions from a mixture of lumiphoric materials, or discrete layers of lumiphoric material, including red, yellow, and green lumiphoric materials. LED chips of different wavelengths can be present in the same group of solid state emitters, or can be provided in different groups of solid state emitters. A wide variety of wavelength conversion materials (e.g., luminescent materials, also known as lumiphors or lumiphoric media, e.g., as disclosed in U.S. Pat. No. 6,600,175, issued on Jul. 29, 2003, and U.S. Patent Application Publication No. 2009/0184616, filed on Oct. 9, 2008, each disclosure of which is hereby incorporated by reference herein in the entirety, are well-known and available to persons of skill in the art. Utilizing multiple layers of phosphor with LED chips is discussed by way of example in U.S. patent application Ser. No. 14/453,482, filed Aug. 6, 2014, the disclosure of which is hereby incorporated by reference herein in the entirety. Again and as noted above with reference to commonly owned U.S. provisional patent application Ser. No. 62/262,414A, a plurality of blue-shifted-yellow and/or blue-shifted-green LEDs as well as a plurality of blue-shifted-red LEDs may be used. Herein, the term "blue-shifted-yellow LED" refers to an LED that emits light in the blue color range that has an associated recipient luminophoric medium that includes phosphor(s) that receives the blue light emitted by the blue LED and in response thereto emits light having a peak wavelength in the yellow color range. A common example of a blue-shifted-yellow LED is a GaN-based blue LED that is coated or sprayed with a recipient luminophoric medium that includes a YAG:Ce phosphor. Similarly, as used herein the term "blue-shifted-green LED" refers to an LED that emits light in the blue color range that has an associated recipient luminophoric medium that includes phosphor(s) that receives the blue light emitted by the blue LED and in response thereto emits light having a peak wavelength in the green color range, and the term "blue-shifted-red LED" refers to an LED that emits light in the blue color range that has an associated recipient luminophoric medium that includes phosphor(s) that receives the blue light emitted by the blue LED and in response thereto emits light having a peak wavelength in the red color range. In some cases, a recipient luminophoric medium that is associated with a blue LED may include, for example, both green and yellow phosphors. In such a case, if the peak wavelength of the combined light output by the green and yellow phosphors is in the yellow color range, the LED is considered to be a blue-shifted-yellow LED, whereas if the peak wavelength of the combined light output by the green and yellow phosphors is in the green color range, the LED is considered to be a blue-shifted-green LED. In accordance with the disclosure herein, at least one or more LED(s) of each of the different colors can be used. In some aspects, only two LEDS can be used where each LED is of a different color, such as for example at least one blue shifted yellow (BSY) and at least one blue shifted red (BSR).

Obtaining a desired color rendering index (CRI) can be achieved by using a single, primary color of LED chip or by mixing multiple colors of LED chips. In some aspects, mixing red or red-orange (RDO) chips and BSY chips results in warm white light in a direct drive configuration. LED chips can be combined to produce a desired CRI that is approximately equal to 80 or greater, or approximately equal to 90 or greater than 90.

In some aspects, lighting components as described herein are operable to output of at least approximately 90 lumens per watt (LPW) or more, approximately 90 lumens per watt (LPW) or less, at least about 100 LPW or more, at least approximately 110 LPW or more, at least approximately 120 LPW or more, and up to at least approximately 140 LPW or more, at approximately 30 Watts (W). One or more of the foregoing LPW thresholds are attained for white light emissions using either BSY intermixed with RDO chips or only BSY chips for phosphor converted white light. White light emissions of components and/or systems herein have x, y color coordinates within four, seven, or ten MacAdam step ellipses of a reference point on the blackbody locus of a 1931 CIE Chromaticity Diagram.

The term "color" in reference to a light emitter (e.g., an LED chip or package) refers to the color and/or wavelength of light that is emitted by the chip or package upon passage of electrical current therethrough. As used herein, the terms "natural" and "vivid" color refer to a light emission having a high CRI as further described herein (e.g., greater than 80 CRI and also greater than 90 CRI) and a spectral power distribution having a color gamut (Qg) that is greater than 100 when energized. For example, according to publically available color gamut Qg plots regarding naturalness and vividness, there are "vivid" regions where CRI is 90 or above and the Qg is 100 or above, and there are also "vivid" regions where CRI is 80 or above and the Qg is 100 or above.

Some embodiments of the present subject matter can use solid state emitters, emitter packages, fixtures, luminescent materials/elements, power supply elements, control elements, and/or methods such as described in U.S. Pat. Nos. 7,564,180; 7,456,499; 7,213,940; 7,095,056; 6,958,497;

6,853,010; 6,791,119; 6,600,175, 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862, and/or 4,918,497, and U.S. Patent Application Publication Nos. 2009/0184616; 2009/0080185; 2009/0050908; 2009/0050907; 2008/0308825; 2008/0198112; 2008/0179611, 2008/0173884, 2008/0121921; 2008/0012036; 2007/0253209; 2007/0223219; 2007/0170447; 2007/0158668; 2007/0139923, and/or 2006/0221272; U.S. patent application Ser. No. 11/556,440, filed on Dec. 4, 2006; with the disclosures of the foregoing patents, published patent applications, and patent application serial numbers being hereby incorporated by reference as if set forth fully herein.

Various illustrative features are described below in connection with the accompanying figures.

Figure 1B:
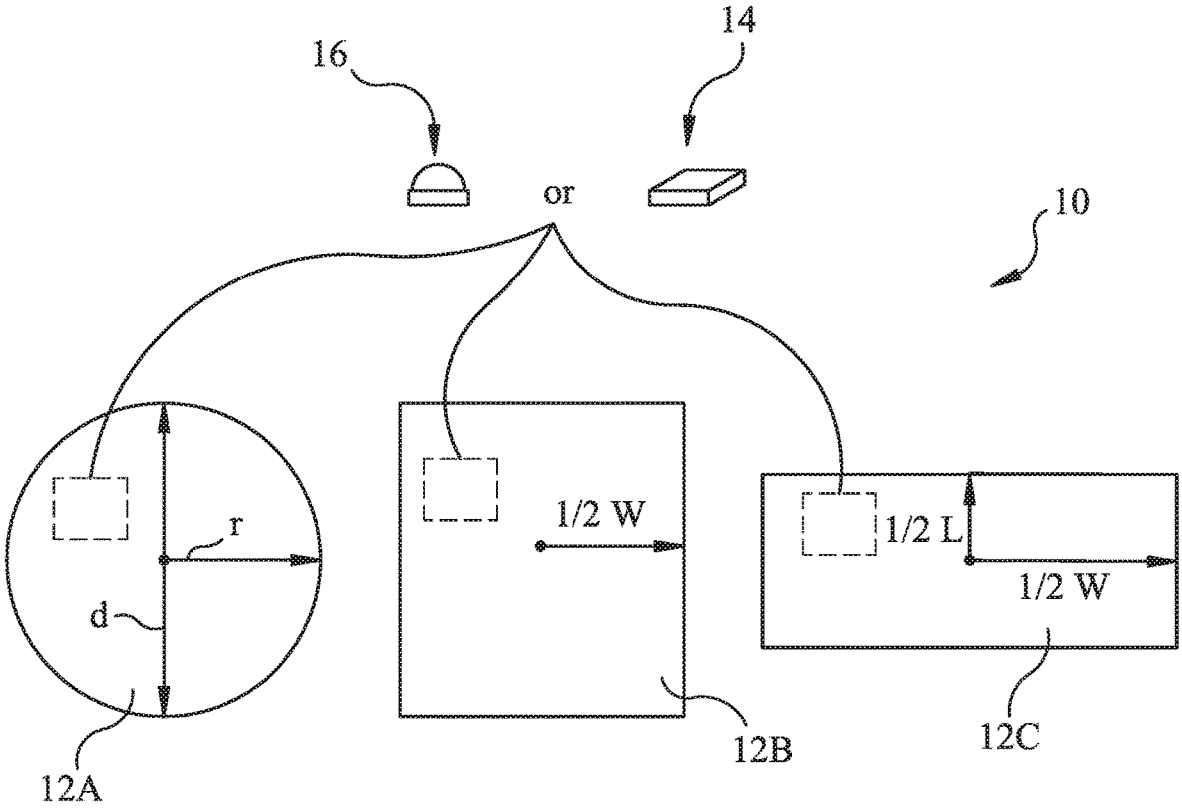

FIGS. 1A and 1B are side and plan views of solid state light emitter boards, generally designated 10, according to some aspects. Solid state light emitter boards 10 can comprise a substrate 12 (FIG. 1A) over which one or more solid state light emitters can be disposed. Substrate 12 can comprise any suitable structure for supporting one or more solid state light emitters. An exemplary substrate 12 can comprise a PCB, an MCPCB, a flexible circuit board, a dielectric laminate, a ceramic based substrate, a metal substrate, an FR4 board, or the like.

Substrate 12 can optionally comprise a plurality of electrically conductive traces (not shown) arranged on one or multiple surfaces thereof for passing electrical current into the light emitters and driving the light emitters to provide a desired luminous output. The electrically conductive traces can electrically activate and illuminate the light emitters connected thereto, and the electrical traces can comprise any suitable pattern or shape, provide any suitable connectivity (e.g., for connecting light emitters in series, parallel, and/or combinations thereof), be at least partially covered (e.g., with a reflective coating or solder mask) or left uncovered, where desired. In some aspects, board 10 can comprise a component having traces and solid state light emitters disposed over the traces as discussed, for example, in commonly assigned and co-pending U.S. patent application Ser. No. 13/769,273, filed on Feb. 15, 2013, and U.S. patent application Ser. No. 13/769,277 filed on Feb. 15, 2013, the disclosure of each of which is hereby incorporated by reference herein, in the entirety.

At least one or more light emitter can be mounted to and/or supported by substrate 12. In some aspects, a plurality of light emitters can be mounted to and/or supported by substrate 12. Light emitters can comprise any suitable light source; such as for example light emitter chips 14 or light emitter packages 16, optionally arranged within a pattern and/or an array. Light emitter chips 14 can comprise, for example, LED chips configured to emit primarily red light, primarily green light, primarily blue light, BSY light, red or red-orange (RDO) light, primarily cyan light, primarily amber light, UV light, etc., upon being energized with electrical current. In some embodiments, light emitter chips 14 are configured to emit a same color of light. In other embodiments, components herein utilize at least two light emitter chips 14 configured to emit a respective first and second color of light. Light emitter chips 14 may include at least a first light emitter configured to emit a first color of light that is primarily blue, and at least a second light emitter configured to emit a second color of light that is primarily red. Any combination of light emitters that emit any number of different colors may be provided in a component set forth herein.

In some aspects, only a single chip 14 is provided per board 10. In further aspects, two or more chips 14 are provided per board in a chip-on-board (COB) arrangement or array. Any number, size, shape, structure (e.g., vertical vs. horizontally structured), arrangement (e.g., serial, parallel, or both), and/or color of chip 14 and/or chips 14 can be provided per board 10. Where COB LED light emitter chips 14 are used, each chip 14 can optionally be individually encapsulated within a silicone resin, with or without phosphor. Where packages 16 are used, each package 16 can be individually encapsulated with a lens and/or encapsulant.

Where multiple emitter chips 14 and/or packages 16 are used, the multiple emitters can be serially connected, connected in parallel, or serially connected in multiple strings where the multiple strings are connected in parallel. Any connection scheme can be used or provided. In some aspects, multiple RDO and BSY strings of emitters are used on board 10 for incorporation into components described herein. In some aspects, light emitters can be tightly packed within an intermixed array of BSY and RDO emitters for improved color rendering and a more uniform color. An example of intermixing LED chips for improved color rendering and/or light emission is described in U.S. patent application Ser. No. 12/288,957, filed on Oct. 24, 2008, the disclosure of which is incorporated herein by reference, in the entirety.

Where used, light from the red-emitting light emitters have a dominant wavelength from approximately 600 to 640 nm, light from the blue-emitting light emitters (e.g., that combine with phosphor to emit BSY light) have a dominant wavelength from approximately 435 to 490 nm, and light from phosphor used with the blue-emitting light emitters has a dominant wavelength from approximately 540 to 585 nm. In some aspects, components and systems herein have an improved color rendering (e.g., vivid, bright, and approximately 80 or greater CRI or even 90 or greater CRI) by virtue of intermixing BSY and RDO chips and/or packages.

Still referring to FIGS. 1A and 1*n* some aspects, at least one light emitter package 16 can be provided per board 10. Light emitter packages can comprise a submount, at least one LED chip disposed on or over the submount, and an optical element such as a lens and/or encapsulant disposed over the LED chip. Exemplary packages are shown and described, for example, in commonly owned and assigned U.S. Pat. Nos. 6,515,313; 6,600,175; 6,906,352; 7,312,474; 7,446,345; 7,692,182; 7,943,945; 8,217,412; 8,669,573; 8,622,582; 8,659,034; D582,866; D594,827; D615,504; D623,607; D635,527; D641,719; D648,686; D659,657; D671,661; D656,906; D711,840; D709,464; and/or D711,841, and the disclosures of each of the foregoing patents are incorporated by reference herein, in the entirety, as if set forth fully herein.

In some aspects, only a single LED package 16 is provided per lighting component. In other aspects, multiple LED packages 16 are provided per lighting component. Each LED package 16 can for example have a length-by-width dimension of at least approximately 1 mm×1 mm or more, at least 2.0 mm×2.0 mm or more, at least approximately 3.5×3.5 mm or more, for example, approximately 5.0 mm×5.0 mm or more.

FIG. 1B illustrates several exemplary schematic top plan views of board substrates 12. Substrate 12A is a substantially circular board substrate, Substrate 12B is a substantially square board substrate, and substrate 12C is a substantially rectangular board substrate. Substrate 12 (FIG. 1A) can comprise any size and/or shape. Substrate 12 (FIG. 1A) can comprise a symmetric shape, an asymmetric shape, a regular shape, and irregular shape, or the like. Any shape of substrates, such as for example substrates 12A, 12B, and/or 12C, can be provided.

As FIG. 1B further illustrates, at least one light emitter can be mounted over each respective substrate 12A, 12B, and 12C. The light emitter is schematically illustrated as a broken box, as it can comprise at least one light emitter chip 14 or at least one light emitter package 16.

Each respective substrate 12A, 12B, and 12C illustrated in FIG. 1B can comprise a planar or a non-planar upper surface over which the at least one light emitter is disposed. Portions of the upper surfaces of substrates 12A, 12B, and 12C can each comprise a light emitter surface, as it is the surface over which light emitters are mounted and the surface from which emitters are configured to emit light. Each light emitting surface can be all or a portion of the top surface of each substrate. Substrates 12A, 12B, and 12C are boards having a light emitter surface having an area. The area can be calculated depending on the substrate configuration, where for a circular configuration the area is determinable from the diameter since the radius is half of the diameter and the area of a circle is Area=Pi*radius$^2$.

For a non-circular configuration such as a rectangular or square configuration, the area is determined from the overall length L and width W. For example and in some aspects, substrate 12A can comprise a light emitter surface with a surface area calculated from a diameter d that is approximately 12 mm or more (and radius r of 6 mm or more), a diameter d of approximately 19 mm or more (and radius r of 9.5 mm or more), a diameter d of approximately 25 mm or more (and radius r of 12.5 mm or more), a diameter d of approximately 30 mm or more (and radius r of 15 mm or more), and/or a diameter d of approximately 40 mm or more (and radius r of 20 mm or more). In an exemplary embodiment, substrate 12A can be at least substantially circular and have an overall diameter d of approximately 19 mm and a radius r of approximately 9.5 mm. In one aspect, such a component can be used within a component having a depth of approximately 68 mm and an opening diameter (mouth) of approximately 105 mm.

Still referring to FIG. 1B and in some aspects, substrate 12B (and therefore the light emitting surface which can be all or a portion of the top surface of substrate 12B) can have a width W and a half-width (½ W), where the width W can be approximately 12 mm or more (i.e., and a half-width of approximately 6 mm or more), approximately 19 mm or more (i.e., and a half-width of approximately 9.5 mm or more), approximately 40 mm or more (i.e., and a half-width of approximately 20 mm or more), and/or approximately 50 mm or more (i.e., and a half-width of approximately 25 mm or more).

Substrate 12C (and its light emitting surface again, which can be all, or a portion of the top surface of substrate 12C) can have a length L and a width W, where the length L is unequal to the width W. Substrate 12C can have a half-length (½ L) and a half-width (½ W), where the length-by width (L×W) can be any desired measurement.

Notably, optical properties associated with lighting components having light emitter boards 10 as described herein can be improved via the use of one or more light directing or focusing structures or optics (e.g., reflectors, lenses, optionally textured optical elements, or the like) and/or diffusers (e.g., diffusing components or elements) disposed at various locations with respect to board 10 (FIG. 1A). Optics, including but not limited to reflectors and diffusers, can be positioned at various positions or locations with respect to board 10 for providing components having an improved central spot light, an improved center beam candlepower, an improved color rendering, an improved (tighter) color uniformity, and/or a more desirable intensity profile.

As described herein, lighting components can utilize at least one optical diffuser that is spaced a distance away from the one or more light emitter. For example, components herein can utilize a diffuser that is spaced a separation distance away from one or more light emitter where the separation distance is greater than the radius (e.g., r, FIG. 1B) of the light emitter surface of board 10 or at least greater than the half-width (½ W, FIG. 1B) of board 10 for improving color mixing and color uniformity collectively emitted by differently colored LED chips and/or packages disposed on or over board 10 (FIG. 1A).

Substrates 12A, 12B, and 12C can further comprise any suitable thickness, for example, approximately 0.5 mm or more, approximately 1 mm or more, approximately 2 mm or more, approximately 2.5 mm or more, or more than approximately 3 mm.

Figure 2A:
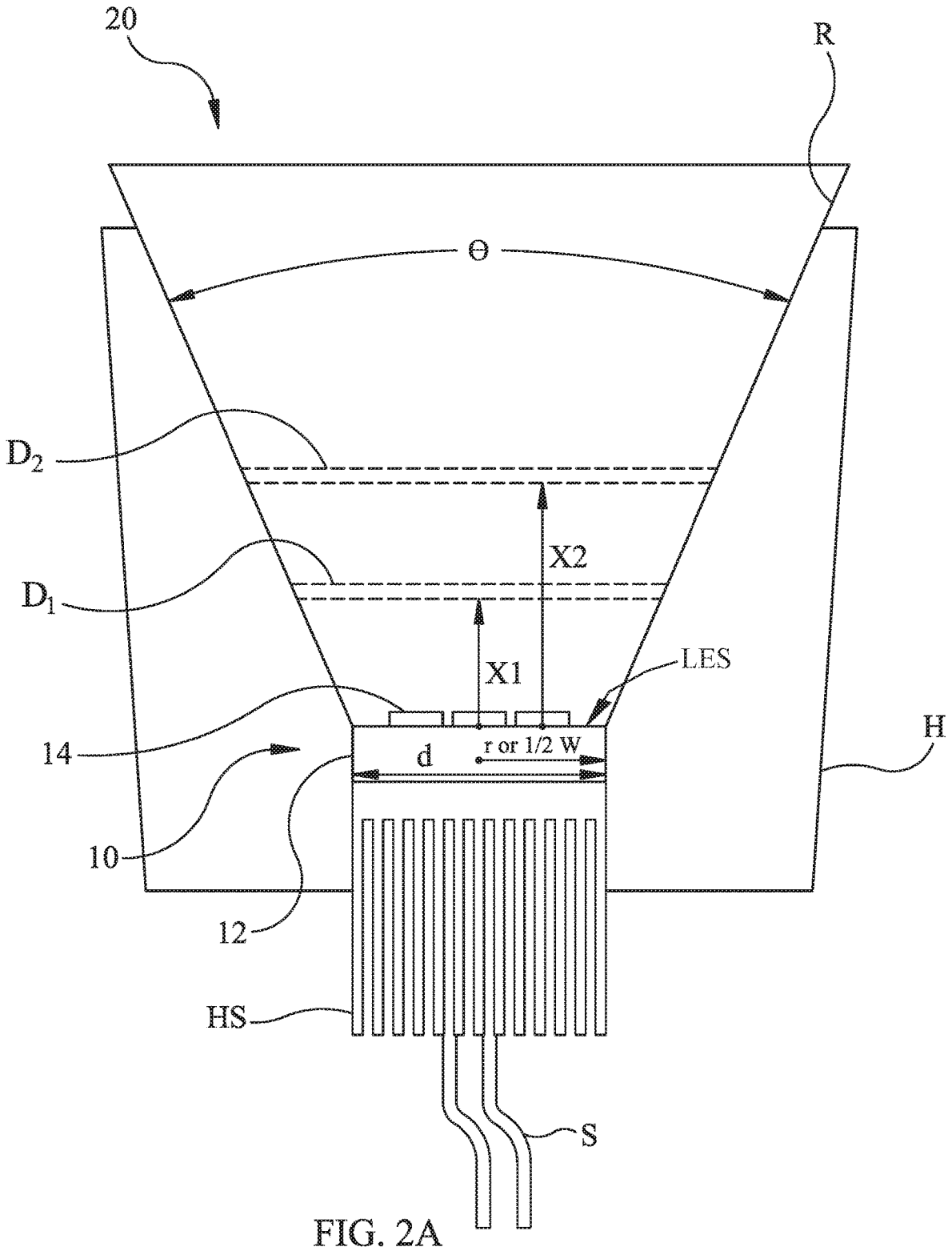
FIGS. 2A through 2D are sectional views of solid state lighting components according to some aspects.
Figure 2B:
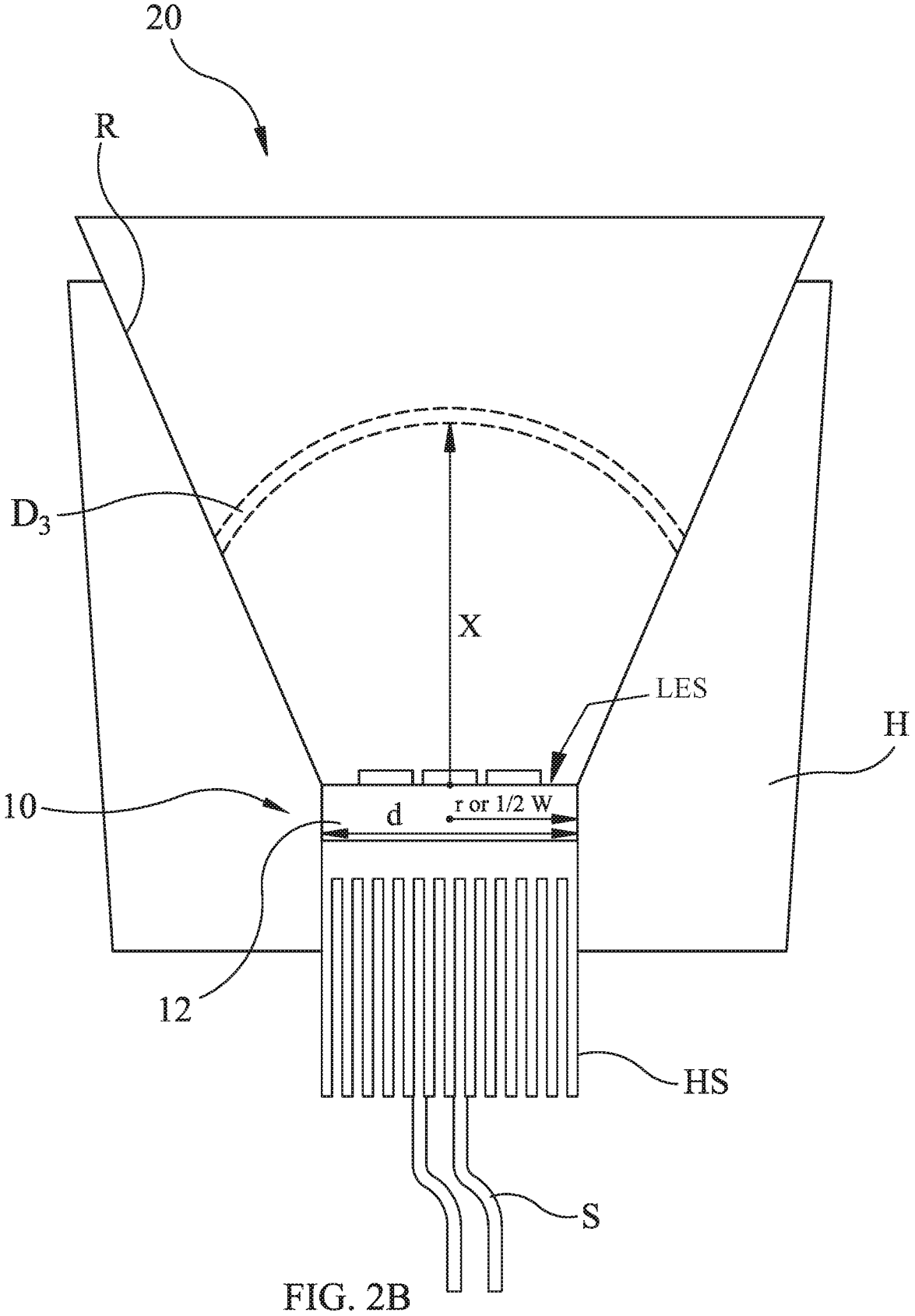
Figure 2C:
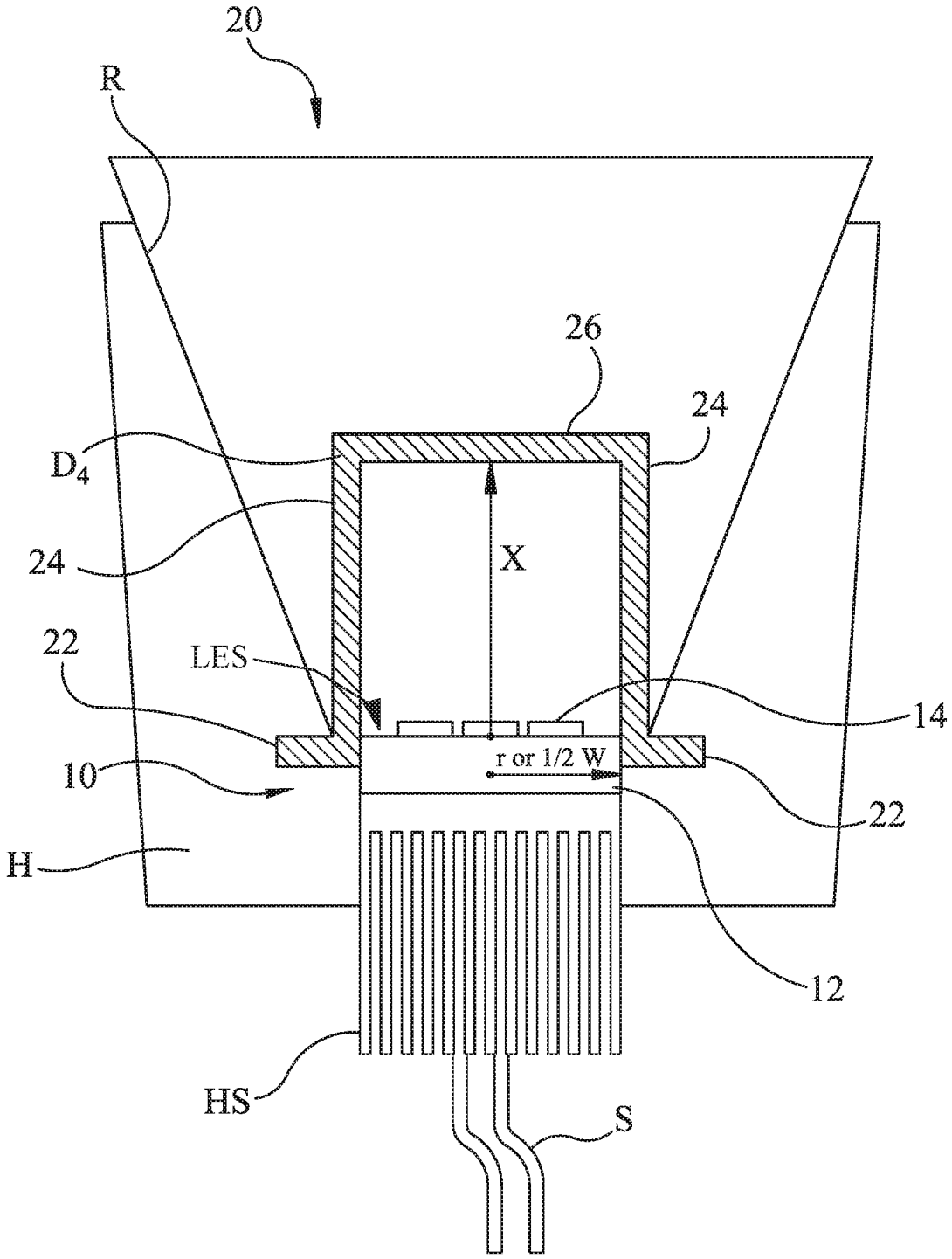

FIGS. 2A to 2C are sectional views of a solid state lighting component, generally designated 20, according to some aspects. Component 20 can comprise a lighting module or fixture configured to emit white light when light emitters are energized or activated via electrical current. Component 20 can comprise a board 10 (FIG. 1A), having one or more light emitter chips 14 and/or packages 16 (FIG. 1A) disposed thereon. For illustration purposes, component 20 is shown as having COB light emitter chips 14 mounted to and/or supported by substrate 12, and therefore disposed on or over substrate 12, however, light emitter packages (e.g., 16, FIG. 1A) can also be provided in addition to or instead of chips 14, or in combination with chips 14.

Referring generally to FIGS. 2A through 2D, component 20 is configured to diffuse and reflect light that is emitted by one or more energized light emitter chips 14 for providing directional lighting operable to emit at least 90 LPW or more, at least 100 LPW or more, at least 120 LPW or more, or at least 140 LPW or more. In some aspects, component 20 is configured to emit at least 140-155 LPW or more, and the center beam candlepower can comprise approximately 14,000 candela (cd) or more and the component can comprise or be configured for approximately 4.0 candela per lumen (cd/lm) or more. In some aspects, component 20 is configured to deliver directional lighting, where the center beam candlepower can comprise approximately 14,500 candela (cd) or more and comprising or configured for approximately 4.7 candela per lumen (cd/lm) or more.

In some aspects, component 20 is configured to emit light having a beam angle θ of approximately 60° or less. In some aspects, the beam angle can be approximately 15° or more, approximately 20° or more, approximately 25° or more, approximately 30° or more, approximately 40° or more, and/or approximately 60° or more. As will be appreciated by persons of skill in the art, any size and/or shape of component can be provided for outputting any desired beam angle of light. In some aspects, the beam of light emitted by component 20 is focused using a light directing optic or structure, such as a reflector R.

In some aspects, board 10 can be disposed over, mounted to, and/or otherwise supported by a heatsink HS. Heatsink HS can comprise any suitable material (e.g., a metal, ceramic, a heat-sinking composite material, or the like) that is thermally conductive. Heatsink HS is configured to dissipate heat that is generated by emitter chips 14 to a surrounding medium (e.g., air) for improving efficiency of component 20. In some aspects, heatsink HS comprises a metallic material having one or more fins for dissipating heat from board 10 and/or light emitters disposed thereon.

Still referring to FIGS. 2A through 2C in general, and in some aspects, component 20 comprises an outermost housing H disposed about a light focusing or directing structure or optic, such as a reflector R. Component 20 can comprise a lighting module disposed within a portion of an outermost plastic, glass, ceramic, polymeric, or metallic housing H. In some aspects, exemplary housing H structures and/or materials are shown and described in commonly owned and assigned U.S. Pat. Nos. 8,777,449 and 8,057,070 the disclosures of each of which are incorporated by reference herein in the entirety. Housing H is configured to mount to an existing component (e.g., a beam or electrical socket) for providing directional lighting from board 10 housed therein. As will be appreciated by persons of skill in the art, any size, shape, and/or type of housing may be provided.

In some aspects, reflector R can comprise any structure and/or material that is configured to reflect and/or focus light. Reflector R can comprise a two-dimensional structure or a three-dimensional structure not limited to a film, a sheet, a cone, a plate, and/or a parabolic reflector as illustrated. As will be appreciated by persons of skill in the art, any size, shape, and/or type reflector R can be provided. Reflector R can be disposed about portions of board 10 and emitter chips 14. In some aspects, reflector R is disposed around a perimeter of a surface area occupied by light emitter chips 14, the surface area occupied by light emitter chips defines a light emitter surface of board 10. Reflector R can, in some aspects, comprise one or more reflective particles that are embedded within a film, a sheet, a cone, a plate, and/or a segmented parabolic reflector that is disposed about board 10.

In other aspects, reflector R can comprise a reflective surface that is substantially smooth or optionally texturized, depending upon the desired end-use and application. For example, smooth and/or minimally texturized reflectors and/or reflective surfaces provide a more centralized hot spot, which is desired for spot lighting applications. Increasing the texture of the reflector and/or reflective surface will result in a flatter intensity profile. The reflective surface of reflector R refers to a surface or wall that is impinged with light emitted by light emitters, and reflective to the light. For example, an inner surface or wall of reflector R that surrounds board 10 can comprise a reflective surface.

A texturized reflector R can comprise one or more surface features over a reflective surface thereof, such as one or more angled walls, angled portions, angled facets, spheres, spheroids, angular shapes, domes, micro-domes, micro-patterns, reflective structures, or the like. In some aspects, reflector R can comprise one or more facets within facets. Any type of reflector R having a reflective surface (e.g., smooth or texturized) can be provided. Reflector R can also comprise any material, such as a metal, plastic, glass, ceramic, or combinations thereof. Any suitable reflector R comprised of a reflective material (e.g., silver (Ag), aluminum (Al), a metal, or a metal alloy) can be provided. In some aspects, reflector R patterns (e.g., texturized patterns) influence the beam angle, and the impact of the diffusing optic will be limited as long as it is seated within the reflector at a depth of between approximately 15% and 45% of the overall depth of the reflector and a minimal direct line of sight to the outside.

Any desired reflector R and/or reflective element can be employed, and persons skilled in the art are familiar with and have access to a variety of such reflective elements. In some embodiments of the present subject matter, reflector R is shaped, texturized, and/or positioned so as to cover at least part of the internal surface of the sidewall of the lighting component 20 and/or housing H. Reflector R is configured to extend away from the light emitter source (e.g., board 10 with emitters 14) and focus the light to have a beam angle of approximately 20° to 30° (e.g., approximately 25°), however any beam angle can be produced via reflector R.

FIGS. 2A through 2D illustrate different configurations, placements, positions, locations and/or dispositions of a diffuser (e.g., D1 to D4) or diffusing optic provided within a portion of reflector R and housing H. In some embodiments, the diffusing optic (e.g., diffusers D1 to D4) are centered with respect to the reflector R and/or coaxially disposed with respect to the reflector R. Referring to FIG. 2A, component 20 comprises a board 10 having a substrate 12 comprising a first surface and a first surface area determined by an overall length, width, and/or diameter. In some aspects, the surface area is determined by an overall width that is a diameter d. At least one light emitter, such as a light emitter chip 14, is provided on the first surface of substrate 12. The light emitter can comprise a chip 14 or a package (e.g., 16, FIG. 1A). Diffuser D1 can be disposed over one or more light emitter chip 14 and substrate 12 and its light emitting surface LES. At least a portion of diffuser D1 can be provided at a first separation distance X1 over the surface of light emitting surface LES. A first separation distance X1 can be greater than one-half of the width of the light emitting surface LES or of the width used to determine the surface area of the light emitter surface of substrate 12, for example, one-half of diameter d, which is greater than radius r (e.g., where substrate 12 is circular).

Where substrate 12 is non-circular (e.g., a square or rectangle), first separation distance X1 can be greater than one-half of the overall width or length of substrate 12 (e.g., greater than ½ W or ½ L, FIG. 1B). Where board 10 is approximately 19 mm in overall width and/or diameter d, diffuser D1 can be located a first separation distance X1 of more than 9.5 mm (e.g., >½ W or >r) above board 10 and respective chips 14. Any separation distance greater than the half-width (½ W) and/or radius r of the light emitting surface LES or substrate 12 is envisioned herein. In some aspects, a single diffuser D1 is disposed or raised over board 10 a separation distance X1 that is approximately 19 mm or more, which is equal to diameter d of the light emitter surface of board 10. In some aspects, components not having at least some separation distance X1 between the lighting source and the diffuser produce insufficient color mixing and steeper intensity profiles.

In some aspects, diffuser D1 is disposed or raised a separation distance X1 that is approximately equal to between approximately 15% and 45% of the overall reflector R depth as measured from a bottom (base) of reflector to a top (opening) of reflector. In some aspects, diffuser D1 is disposed or raised a separation distance X1 that is approximately equal to 30% of the overall reflector R depth, which is about 19 mm, which is also diameter d or width W of the light emitter surface or substrate 12 for a reflector having a depth of about 68 mm. Other configurations are possible however. In some aspects, diffuser D1 is configured to rest inside reflector R to minimize the direct line of sight to the outside. That is, diffuser D1 can be disposed between portions (e.g., between one or more inner walls, between portions of the reflective surface) of reflector R. As diffuser D1 placement also affects beam angle, positions or locations much greater than about 45% of the overall depth of reflector R will enlarge the beam angle until it is too large and undesired. Thus, optimization of diffuser D1 location is within reflector R is desired and achieved.

Diffuser D1 is configured to mix the various colors of light emitter chips 14 (where different colors are employed) into a substantially tight, uniform color from all viewing angles, and/or to provide obscuration of the individual points of light generated by the plurality of chips 14. In optics, the terms "diffuser" and "diffusing optics" refer to any device that diffuses, spreads, or scatters light in some manner. Diffuser D1 can comprise any desired diffuser structure or element, as persons skilled in the art are familiar with and have easy access to. In some aspects, diffuser D1 is mounted to component 20 above one or more light emitter chips 14 or packages (e.g., 16, FIG. 1A), whereby light emitted from the light emitters passes through diffuser D1 and is diffused prior to exiting the component into a region that will be illuminated by component 20, for example into a room or building. In some aspects, diffuser D1 can be attached and/or secured to a wall of reflector R, a separate (discrete) spacer, a conduit, or the like. In other aspects, diffuser D1 can comprise a raised design or structure (e.g., a "top-hat" structure), in which the diffuser is supported by a flanged base or body to extend over board 10 and emitter chips 14 (see e.g., FIG. 2C). Diffuser D1 can comprise a planar upper surface and/or a non-planar (e.g., domed, convex, concave, or the like) upper surface for mixing light. Any size, shape, and/or structure of diffuser D1 can be utilized.

FIG. 2A illustrates another possible location of a diffuser, for example, diffuser D2 that can be provided even further above and away from light emitting surface LES and board 10 and one or more chips 14. Diffuser D2 can be provided a separation distance X2 away from or above light emitting surface LES. Separation distance X2 is greater than one-half of the first width (i.e., >½ W), for example, in some aspects greater than one-half of diameter d (i.e., >radius r). In some aspects, diffuser is disposed at any separation distance X2 away from or above light emitting surface LES that is greater than radius r (e.g., where substrate 12 is circular) or ½ of the overall width W of the light emitting surface LES or of the substrate (e.g., FIG. 1B, where substrate 12 is substantially square or rectangular). Diffusers D1 and D2 can be used alone or in combination with each other. Placement of each diffuser D1 and D2 is optional and therefore illustrated in broken lines as the positioning or location of each diffuser D1 and D2 is optional and/or can be varied within reflector R so long as it is greater than a radius r or overall width W.

In some aspects, one or more diffuser (e.g., D1 and/or D2) is positioned at any separation distance greater than a radius r of light emitting surface LES or board 10 and/or at any separation distance greater than one-half of the overall width (e.g., W or L, FIG. 1B) of board 10 and/or light emitter surface LES. In some aspects, one or more diffusers (e.g., D1 and/or D2) are provided at any separation distance greater than approximately 9.5 mm over board 10. In some aspects, at least one diffuser (e.g., D1 or D2) is provided at least approximately 19 mm or more away from or above board 10 and one or more light emitter chips 14 supported on substrate 12 of board 10.

Diffusers (e.g., D1, D2, etc.) can comprise any material, such as glass, plastic, a polymeric material, acrylic and/or any structure not limited to a film, a disk, a sheet, a plate, a lens, a cone, a cover, a dome, or a "top hat" type of design having one or more walls, the walls of which are also optionally light-diffusing.

As FIGS. 2A through 2D further illustrate and in general, electrical power can enter into component 20 for illuminating the light emitter chips 14 via one or more electrical signal carriers, generally designated S. Signal carriers S can comprise electrical wires, circuitry, pins, terminals, a plug, or the like, which are configured to pass electrical signal from a power source (not shown) into component 20 for illuminating or activating one or more light emitter chips 14 or packages 16.

Referring now to FIG. 2B, another embodiment of lighting component 20 is illustrated. In FIG. 2B, a non-planar diffuser D3 can be disposed away from or over board 10 and one or more chips 14. Diffuser D3 can comprise a substantially concave down shaped diffuser D3 that is disposed at a separation distance X away from or above board 10 and chips 14. In some aspects, an apex, or a point of maximum height of diffuser D3 is disposed at a separation distance X that is greater than one-half of the overall width (e.g., any distance greater than r, ½ W, or ½ L, FIG. 2B) of light emitting surface LES or board 10. Separation distance X can be greater than one-half of a diameter d of light emitting surface LES or the board (i.e., greater than radius r) or at any distance greater than one-half of an overall width W.

Referring to FIG. 2C, another embodiment of lighting component 20 is illustrated. FIG. 2C illustrates diffuser D4 having a "top-hat" type of style or structure, in which an upper diffusing surface is supported within component 20 via one or more walls 24 extending from one or more flanges 22. Flanges 22 can be present or absent from this configuration and where present can abut or engage portions of reflector R and/or housing H for securing diffuser D4 within component 20. Diffuser D4 can further comprise a body structure having one or more walls 24 for raising the upper surface 26 (e.g., a diffuser cap or hat) of diffuser D4 away from or above board 10 and one or more chips 14 by at least a separation distance X. As noted above, separation distance X can be any distance greater than radius r and/or greater than one-half of an overall width W of light emitting surface LES or board 10 and/or the light emitter surface of substrate 12. In some aspects, separation distance X is at least approximately 9.5 mm or more, and in some aspects, at least approximately 19 mm. That is, upper surface 26 of diffuser D4 can be disposed away from or raised over or above light emitting surface LES and board 10 by at least separation distance X that is greater than radius r of board substrate 12 and/or greater than one-half of the overall width of light emitting surface LES and board substrate 12. Diffusers (e.g., 01 to D4) described herein are configured to mix light from two or more differently colored chips 14 and/or packages (e.g., 16, FIG. 1A) thereby improving color uniformity and color rendering of light emitted by component 20. Diffusers (e.g., 01 to D4) can be used alone or in combination with other diffusers and/or one or more light directing optic such as one or more reflector R.

In some aspects, emitter chips 14 comprise a plurality of LED chips, where at least some of the chips are configured to emit RDO light and at least some of the other chips are configured to emit BSY light upon being energized by electrical current. RDO and BSY chips can be provided within a spatially mixed over substrate 12 and/or in an alternating (e.g., a checkerboard) arrangement over substrate 12. Intermixing red die (chips) or packages with blue die (chips) or packages can advantageously provide an improved color rendering and a more uniform light distribution, that can be even further improved when used in combination with at least one diffuser (e.g., 01 to D4) and/or at least one optional light directing optic (e.g., R). Red chips can be provided at strategic locations and spatially spread over board 10 in an optionally alternating arrangement over portions of the entire light emitter surface (e.g., the upper surface of substrate 12). At least one diffuser (e.g., D1 to D4) can be provided at least a separation distance X over the light emitter surface, where the distance is greater than a board radius r or one-half of the overall width (i.e., ½ W) used in calculating a surface area of board 10 and/or substrate 12.

Figure 2D:
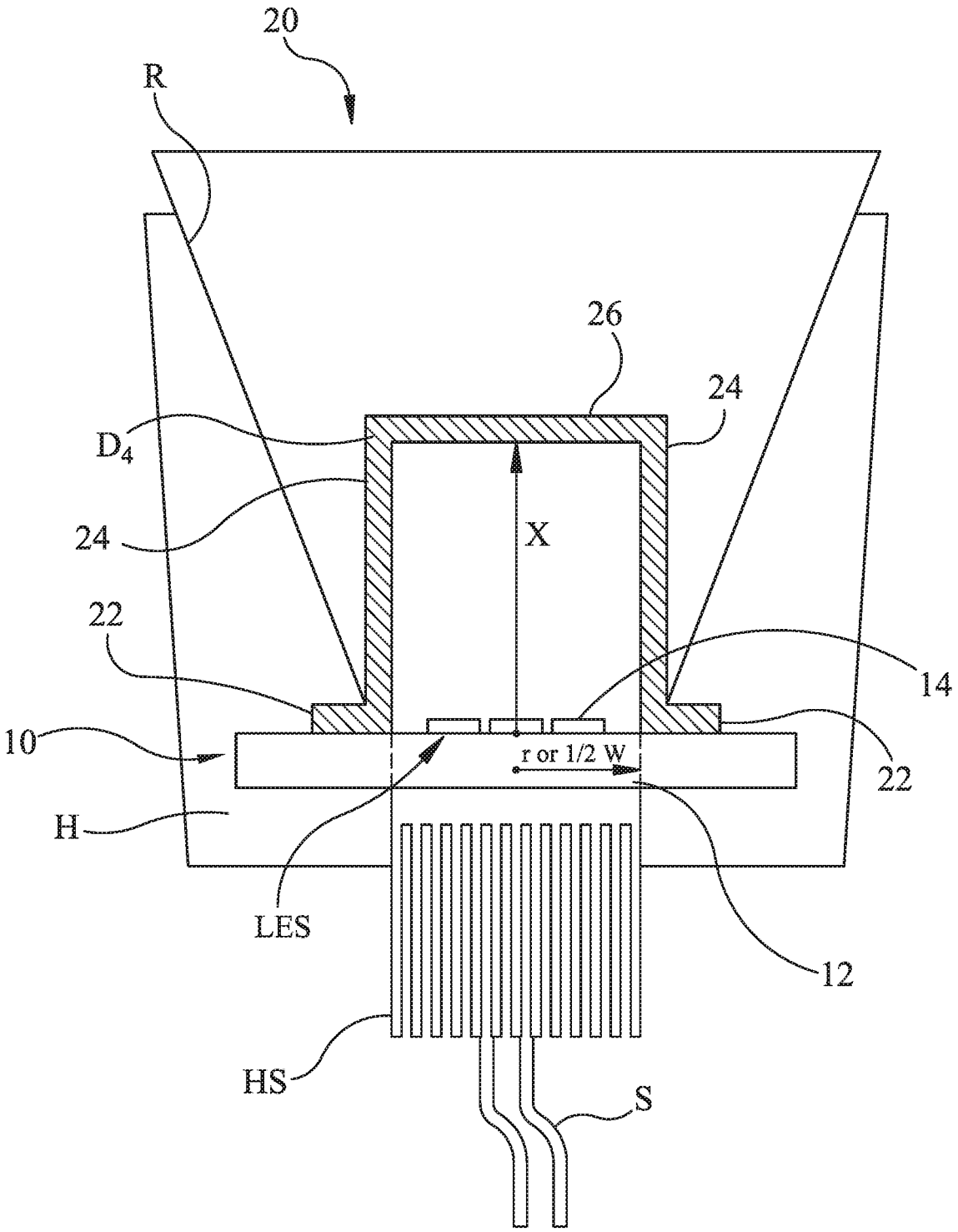

FIG. 2D of the drawings illustrates a configuration similar to that of FIG. 2C and with many of the same features but with board 10 extending past the outer periphery or surfaces of the "brim" portion of the top-hat portion, which brim portion includes flanges 22. Flanges 22 sit on a portion of board 10, for example, a perimeter portion of the board that is disposed outside of the area over which emitters are disposed. An advantage of this configuration or version is the brim of the top-hat configuration, which holds or is attached to diffuser D4, is held in place by being sandwiched between a bottom of the reflector R and the board 10. In this version, separation distance X can still be as shown for FIG. 2C but with the radius or half width of board 10 being calculated only from positions of board 10 that are vertically aligned with outer walls 24 rather than to the actual end(s) of board 10.

It will be appreciated that FIGS. 2A through 2D are for illustrative purposes only and that various components, their locations, and/or their functions described above in relation to these figures may be changed, altered, added, or removed. For example, some components and/or functions (e.g., diffusers, reflectors, heatsink, etc.) may be separated into multiple entities and/or combined into a single entity where desired.

Figure 3A:
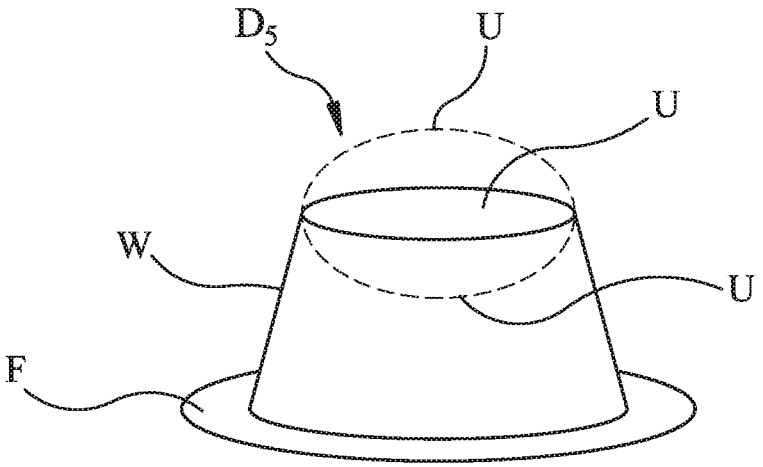
FIGS. 3A through 3E are various views of diffusers or diffusing elements for solid state lighting components according to some aspects.
Figure 3B:
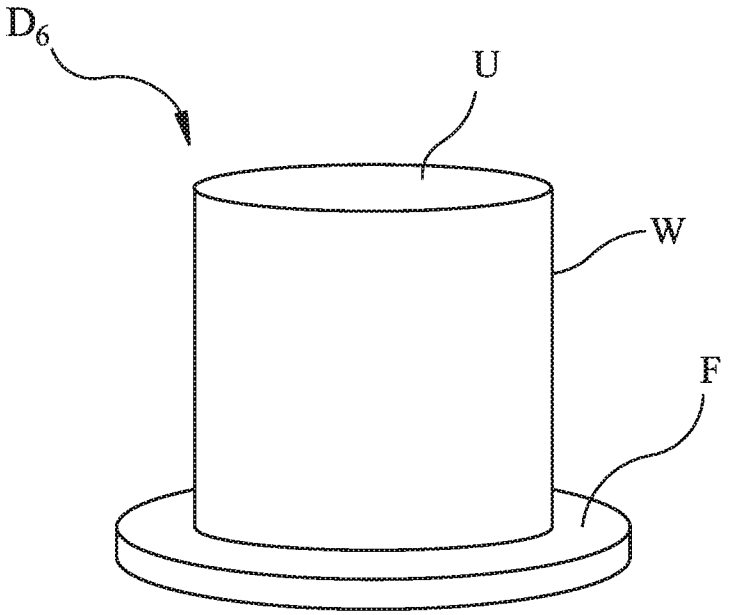

FIGS. 3A through 3E are various views of differently shaped diffusers or diffusing elements for solid state lighting components according to some aspects. FIG. 3A illustrates a diffuser D5, comprising a flange F, one or more walls W, and an upper surface U. In some aspects, upper surface U can be substantially flat or planar. In other aspects, as illustrated in broken lines, upper surface U may optionally be concave or convex over walls W. The one or more diffuser walls W can be disposed at any angle with respect to upper surface U as shown in FIG. 3A. The one or more diffuser walls W can also be substantially orthogonal with respect to upper surface U, as shown in FIG. 3B, which illustrates a diffuser D6. The one or more diffuser walls W can be transparent to light, opaque, light-blocking, light reflecting, or light-diffusing, where desired. Any size, shape, and/or style of diffuser D6 can be provided.

Figure 3C:
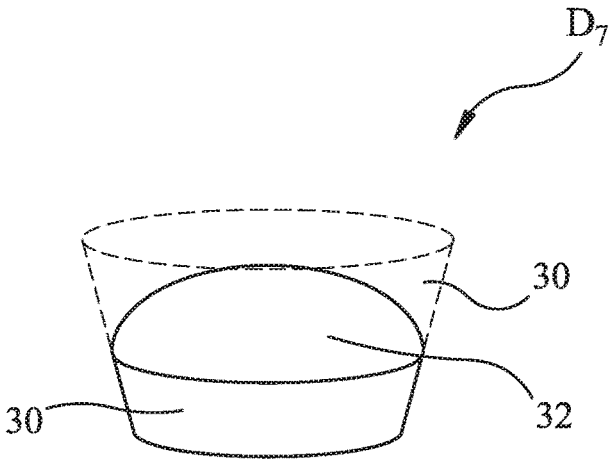

FIG. 3C illustrates a diffuser D7 that can be raised over one or more light emitters (not shown) via a rigid tubing structure, elevating structure, or spacer generally designated 30. Spacer 30 can comprise a substantially cylindrical and/or cone shaped structure configured to elevate a diffusing disk, plate, or cap 32. In some aspects, spacer 30 can comprise a metal or plastic material. In other embodiments, spacer 30 comprises a diffuser cone that diffuses light. As FIG. 3C illustrates in broken lines, spacer walls may extend above and beyond the portions of the diffuser cap 32. It is also envisioned that such extended spacer walls could provide a reflector for directing light passing through diffuser D7, or that a reflector can be attached to the spacer with or without the spacer walls. Spacer 30 is configured to increase a board-to-diffuser distance for improving color mixing, rendering, and overall light emission. The spacer 30 can if desired be integral with and part of a diffuser, or discrete therefrom.

Figure 3D:
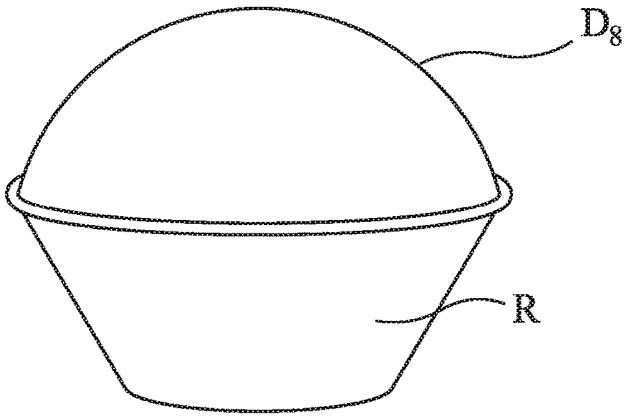

FIG. 3D illustrates a diffuser dome D8 that can be raised above a board (not shown) via a spacer comprising a light directing optic, such as a spacer comprising a reflector R. In this embodiment, the smaller reflector R is configured to raise the diffuser dome away from and above a board (not shown). The smaller reflector R and diffuser dome D8 can then be placed within a second reflector that is a larger and outermost reflector (not shown) and housing, so that dome D8 is disposed at a height that is anywhere between approximately 15% and 45% (e.g., 30%) of the overall height of the larger, outermost reflector.

Figure 3E:
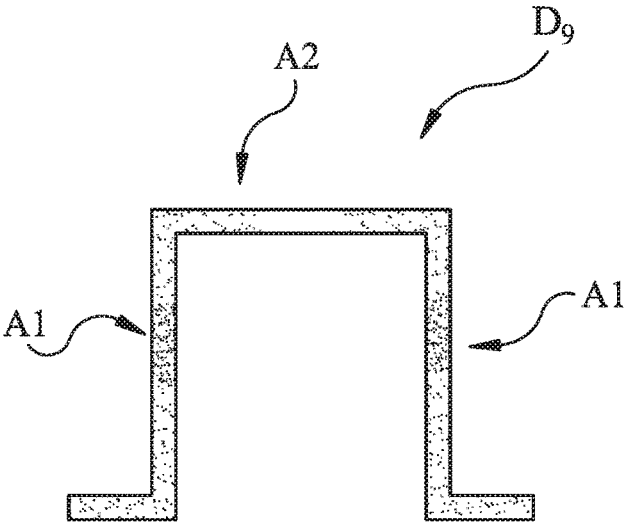

FIG. 3E is a sectional view of a diffuser D9. Diffuser D9 can comprise a non-uniform light scattering structure having different gradients or areas of more diffusion, areas of less diffusion, and/or a gradient between the areas of more and less light diffusion. For illustration purposes, areas that provide more scattering or more diffusion are indicated as areas of denser stippling. Such areas are exemplary only, and may be located or positioned differently as desired. For example, light can be strategically scattered more in at least a first area A1 than a second area A2 for improving color mixing provided by diffuser sidewalls. Diffusion gradients can be provided between areas of less diffusion and areas of more diffusion. Diffusion gradients can be disposed over any surface of diffuser D9, such as over an upper surface, a flange, or one or more sidewalls. As will be appreciated by persons of skill in the art, any size, shape, and/or style of diffuser can be provided.

Figure 4A:
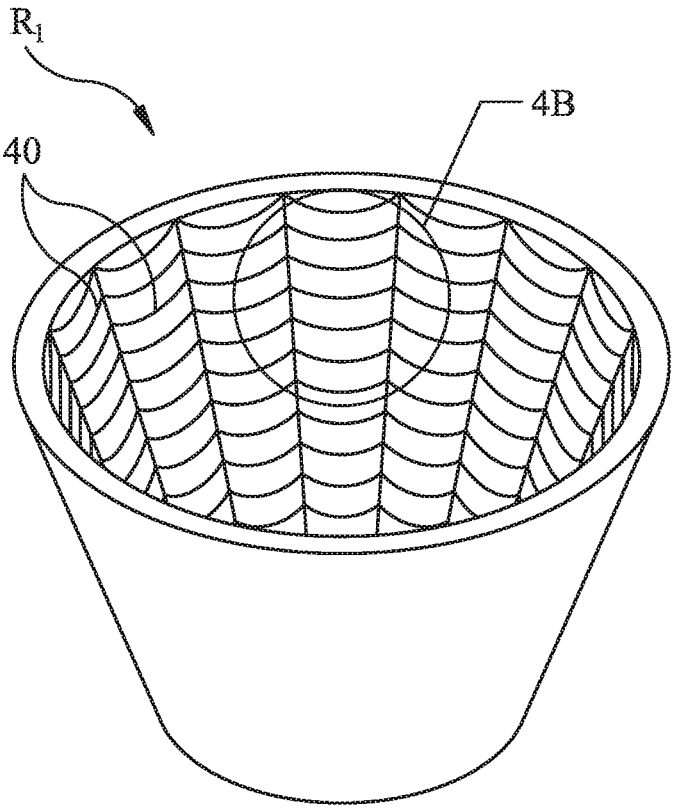
FIGS. 4A and 4B are various views of light directing optics for solid state lighting components according to some aspects.
Figure 4B:
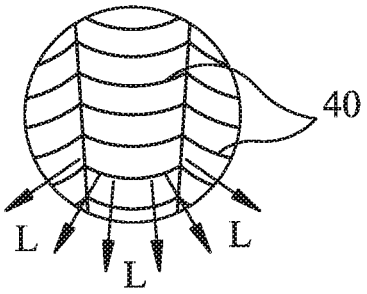

FIGS. 4A and 4B are various views of a light directing optic or reflector, which may be optionally used within a component, in combination with a board and diffuser. As FIG. 4A illustrates, an inner surface of reflector R1 can be texturized for improving color mixing and beam shaping. Reflector R1 may be smooth, minimally texturized, heavily texturized, or combinations thereof. In some aspects as FIG. 4A illustrates, reflector R1 can comprise a reflective surface having plurality of facets 40 for improving color mixing. Facets 40 can be rounded or convexly curved to provide convexly mirrored surfaces, or facets 40 can be flat or some combination of rounded and flat. Facets 40 can improve color mixing and recirculation of light via increasing and randomizing the light angle scattering. Facets 40 can reduce the amount of light loss within the respective component, thereby rendering the component more efficient. Facets 40 can vary in size, and/or change in size as moving from a bottom of the reflector to the top. For example, each facet can comprise a peripheral distance of approximately 5 mm proximate the bottom of the reflector, and increase to a peripheral distance of approximately 10 mm proximate the top of the reflector. Facets 40 are optional, and any sizes, shapes, of facets may be provided and/or a range of different sizes or shapes of facets 40 may be provided.

FIG. 4B illustrates a spread of reflected light rays L imparted via reflection from one facet cell. Facets 40 may advantageously improve the light scattering ability of the respective component, improve the beam size, and focus the light into a focused beam via reflection of light rays into an overall beam angle of approximately 20° to 30°. In some aspects, rounded mirror cells or facets, that can be rounded or flat, are used for maximizing color mixing and randomization. Two directional, complex patterns of cell or facets can also be provided.

Figure 5A:
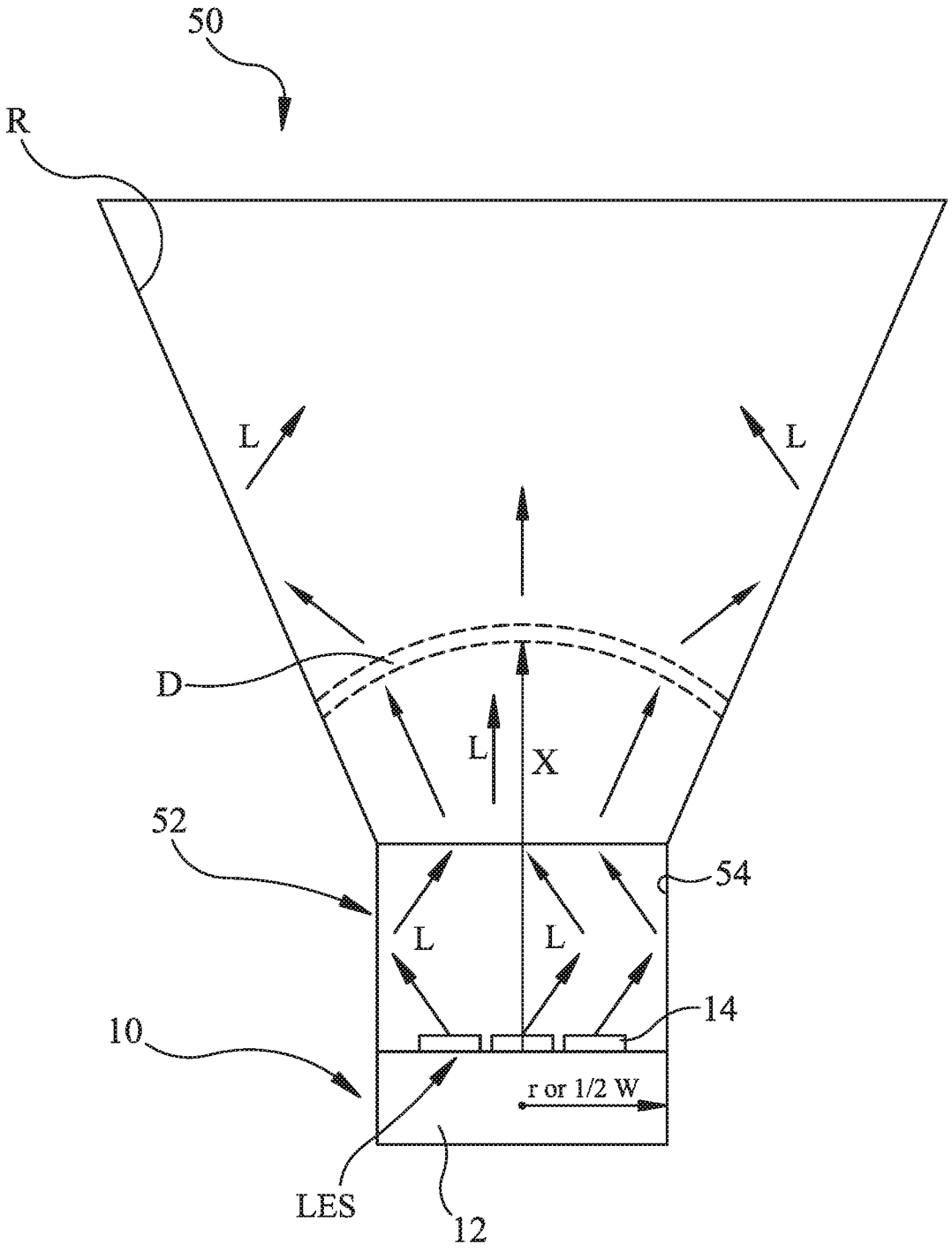
FIGS. 5A through 5D are sectional views of solid state lighting components according to some aspects.
Figure 5B:
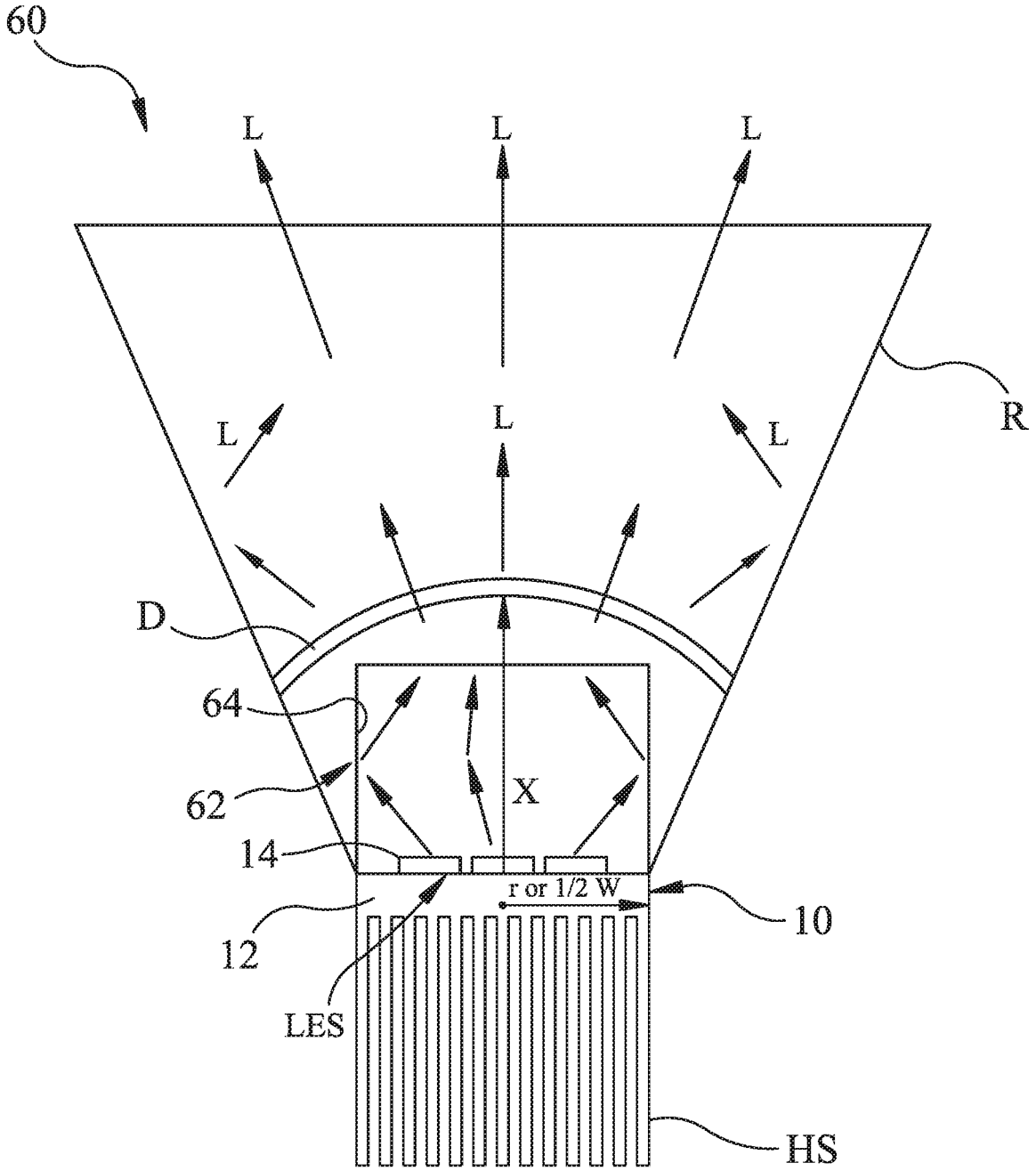

FIGS. 5A through 5D are sectional views of additional embodiments of solid state lighting components 50 and 60, respectively, according to some aspects. FIGS. 5A and 5B utilize a separate spacer that is disposed away from and as shown either above or below a portion of reflector R for pre-mixing red and blue (e.g., BSY) light L prior to the light L passing through a diffuser D. The spacer can also be used to increase the separation distance X between at least a portion of diffuser D and board 10, thereby improving color mixing, scattering, and overall uniformity of white light.

Regarding FIG. 5A and in some aspects, spacer 52 comprises a pre-mixing light conduit or light chamber having a reflective inner surface 54. Light L emitted by one or more light emitter chips 14 or packages (e.g., FIG. 1A) can be reflected, scattered, and/or pre-mixed via spacer 52 prior to passing through diffuser D. Substrate 12 of board 10 comprises a light emitter surface generally designated LES having a light emitter surface area, which has a radius r or half-width (½ W). At least a portion of diffuser D is disposed above board 10 and light emitter surface LES by a separation distance X that is at least greater than a light emitter surface LES radius r or greater than one-half of the width W of the light emitter surface LES. In some aspects, distance X is at least 9.5 mm or more, approximately 10 mm or more, approximately 12 mm or more, approximately 15 mm or more, approximately 19 mm or more, or more than approximately 20 mm. Spacer 52 can if desired be integral with and part of diffuser D.

FIG. 5B illustrates solid state lighting component 60 comprising a spacer generally designated 62 disposed within at least a portion of reflector R that is disposed below diffuser D. Board 10 can be positioned within a portion of spacer 62. In some aspects, spacer 62 forms or defines a conduit or chamber for pre-mixing light. Spacer 62 can comprise a light scattering and/or light reflective inner wall 64. Light L emitted by light emitter chips 14 or packages (e.g., FIG. 1A) can be reflected, scattered, and/or pre-mixed prior to passing through diffuser D to reflector. Substrate 12 of board 10 comprises a light emitter surface LES having a light emitter surface area with a radius r or half-width (½ W). At least a portion of diffuser D is disposed away from or above board 10 and light emitter surface LES by a separation distance X that is greater than light emitter surface LES radius r or greater than one-half of the width W of the light emitter surface LES. In some aspects, separation distance X is equal to or greater than approximately 9.5 mm. In further aspects, separation distance X is approximately equal to a diameter d or overall width W of light emitter surface LES, which can be approximately 19 mm when used within a 68 mm deep reflector R. The position of the diffuser with respect to spacer 62 can be such that the diffuser is spaced apart further from the top of spacer 62 or the diffuser can be part of the top of spacer 62 such that there is not any spacing between the diffuser and spacer 62. Spacer 62 can if desired be integral with and part of diffuser D.

Figure 5C:
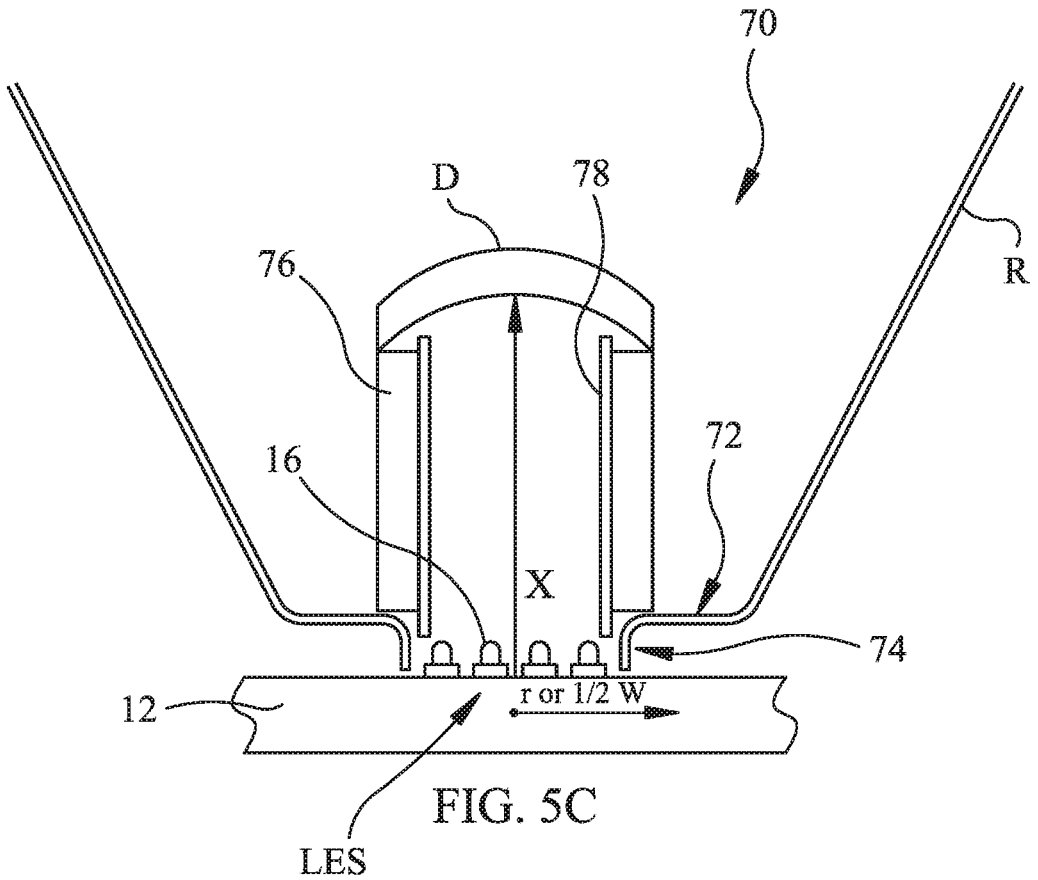

Referring to FIG. 5C, solid state lighting component 70 is illustrated in cross-section view and comprises a reflector R that can be a parabolic or conical type reflector with a large upper opening for light to exit reflector R and an opposing small opening for surrounding one or more light emitter packages 16 (which can also or instead be one or more light emitter chips 14 shown in previous figures). Reflector R comprises a flat bottom generally designated 72 that extends toward an interior of reflector R and toward the small opening of reflector R by at an least substantially orthogonally disposed extension portion generally designated 74 that surrounds light emitter packages 16 and is configured to extend orthogonally toward and/or against substrate 12. The flat portion at the bottom of the reflector R can be substantially parallel to the top surface and light emitter surface LES of substrate 12. Extension portion 74 can surround light emitter packages 16 and extend a distance away from substrate 12 that is a small distance away from and proximate to the upper surfaces of light emitter packages 16 as shown. As such, extension portion 74 can provide and serve as a short reflecting tube for the light emitter packages 16.

In some embodiments, substrate 12 has a light emitter surface generally designated LES on the upper surface of substrate 12 where light emitter packages 16 are mounted, and light emitter surface LES has a radius r or half-width (½ W). A diffuser D is disposed and positioned away from substrate 12 and light emitter surface LES, where at least a portion of the diffuser D is spaced apart from substrate 12 and light emitter surface generally designated LES by separation distance X that is greater than light emitter surface LES radius r or greater than one-half of the width W of the light emitter surface LES. A tube, such as a clear tube 76, can be used to position diffuser D away from substrate 12, and a flexible diffuser sheet 78 can be applied partially or entirely on the interior surface inside (or outside) of tube 76 for diffusing light from light emitter packages 16. Tube 76 can be disposed substantially centrally within reflector R and incorporated with reflector R. The inner diameter of tube 76 can be smaller than at least a portion of the reflector R. Diffuser D can be a domed diffuser that can be configured or cut to match the diameter of tube 76. The dome portion of diffuser D can extend beyond or inside tube 76 as desired. With this configuration, there is some light guiding effect in tube 76 also as the clear tube 76 diameter can be smaller than the reflective tube provided by extension portion 74 and some light enters tube 76 from the ends thereof.

Figure 5D:
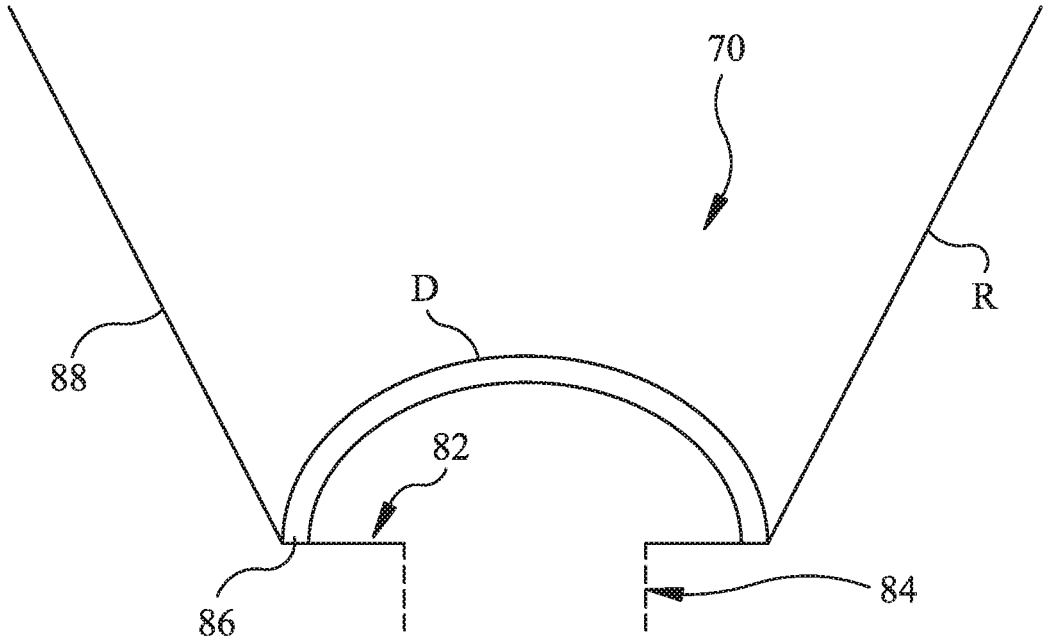

Referring to FIG. 5D, another configuration for a reflector and diffuser is illustrated in cross-section and could be used in place of those shown and described with respect to the solid state lighting component shown in FIG. 5C. Reflector R can again be a parabolic or conical type reflector with a large upper opening for light to exit reflector R and an opposing small opening for one or more light emitters (not shown but which can be light emitter chips or packages such as packages 16 from FIG. 5C). Reflector R comprises a flat bottom generally designated 82 that extends toward the smaller opening of reflector R. An extension portion like or identical to extension portion 74 from FIG. 5C is generally designated 84 in broken lines and can optionally be included to surround light emitter chips or packages and provide and serve as a short reflecting tube for the light emitter chips or packages.

In some embodiments, a diffuser D can be disposed and positioned within reflector R where the diffuser has a lower surface 86 that contacts and/or is supported by flat bottom 82 of reflector R. The outer peripheral surface of lower surface 86 of diffuser D can be positioned against upwardly extending walls 88 of reflector R for additional support for diffuser D. As with FIG. 5C, at least a portion of the diffuser D can be spaced apart from substrate 12 and light emitter surface LES by separation distance X (all shown in FIG. 5C) that is greater than light emitter surface radius r or greater than one-half of the width W of the light emitter surface LES. For the configuration shown in FIG. 5D though, the separation distance can be less than the radius or one-half width of the light emitter surface LES, and this configuration provides an upward-facing reflective surface outside the light emitter surface LES and under the diffuser D.

The dimensions of the light emitter surface and the substrate for all of FIGS. 5A through 5D can be as described for any of the figures herein.

Figure 6:
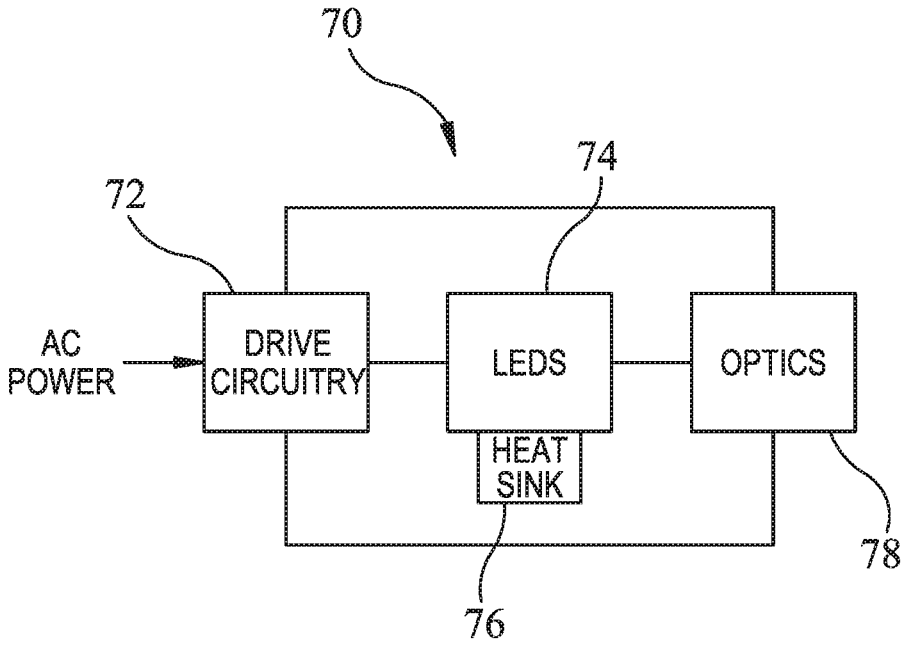
FIG. 6 is a schematic block diagram of a solid state lighting component according to some aspects.

FIG. 6 is a schematic block diagram of a solid state lighting component 70 according to some aspects. Component 70 is configured to receive AC electrical signal or electrical power from an AC power source (not shown). Component 70 can be configured to plug into the AC power source (not shown) for use in various high-brightness lighting applications operable at approximately 30 Watts (W) or more. Although an AC power source is shown and described, component 70 may also be configured to receive direct current (DC) signal.

Component 70 can further comprise various power circuitry or drive circuitry 72 configured to drive one or more LEDs 74 to emit light at a certain output. LEDs 74 can comprise one or more LED chips and/or one or more LED packages. Drive circuitry 74 can comprise one or more resistors, transistors, capacitors, ESD protection components, surge protection components, integrated circuit (IC) components such as IC power chips, or the like for powering the LEDs 74.

LEDs 74 can be provided over at least one heatsink 76. Heatsink 76 can be configured to draw heat away from LEDs 74 so that LEDs 74 can operate or run cooler in steady state, which improves the efficiency of component 70.

Component 70 further comprises one or more optics 78. Optics 78 encompasses both light scattering optics, such as diffusers and light directing optics, such as reflectors. In some aspects, component 70 comprises at least one diffuser that is spaced apart from the LEDs 74 by a separation distance that is greater than a radius r of a board supporting LEDs 74. In some aspects, the separation distance between the substrate supporting LEDs 74 and the diffuser is substantially equal to a substrate diameter (e.g., d, FIG. 2B).

Solid state lighting component 70 is operable to emit light measuring approximately 2000 lumens or more, approximately 2500 lumens or more, approximately 3000 lumens or more, or approximately 3500 lumens or more at approximately 30 W. Component 70 can comprise an efficiency ranging from between approximately 100 LPW and about 150 LPW at warm white temperatures of approximately 2700 K to 3000 K. Component 70 can comprise a CRI of approximately 80 or greater CRI or even 90 or greater CRI. Component 70 can also deliver directional lighting, where the center beam candlepower can comprise approximately 14,000 candela (cd) or more and comprising or configured for approximately 4.0 candela per lumen (cd/lm) or more. In some aspects, component 70 also delivers directional lighting, where the center beam candlepower can comprise approximately 14,500 candela (cd) or more and comprising or configured for approximately 4.7 candela per lumen (cd/lm) or more. All of these features are achieved advantageously with LEDs instead of with CDMH fixtures, and the LED board or surface can as described herein be approximately 19 mm in width or more or approximately 25 mm or more.

It will be appreciated that FIG. 6 is for illustrative purposes only and that various components, their locations, and/or their functions described above in relation to FIG. 6 may be changed, altered, added, or removed. For example, some components and/or functions may be separated or combined into one entity (e.g., disposed on a same board or separate boards).

In some aspects, a solid state lighting spotlight is therefore provided with a substrate, an array of light emitters disposed over the substrate surface, a light directing optic extending from the substrate, a diffuser disposed within the light directing optic and over the light emitters with at least a portion of the diffuser positioned a separation distance away from the substrate surface wherein the separation distance is greater than one-half of the substrate width, and the spotlight configured and being able to emit light with a color rendering index (CRI) of greater than 90 and a lumens per watt efficacy of at least approximately 140 or more, all where the substrate width can for example be approximately 19 mm.

Figure 7A:
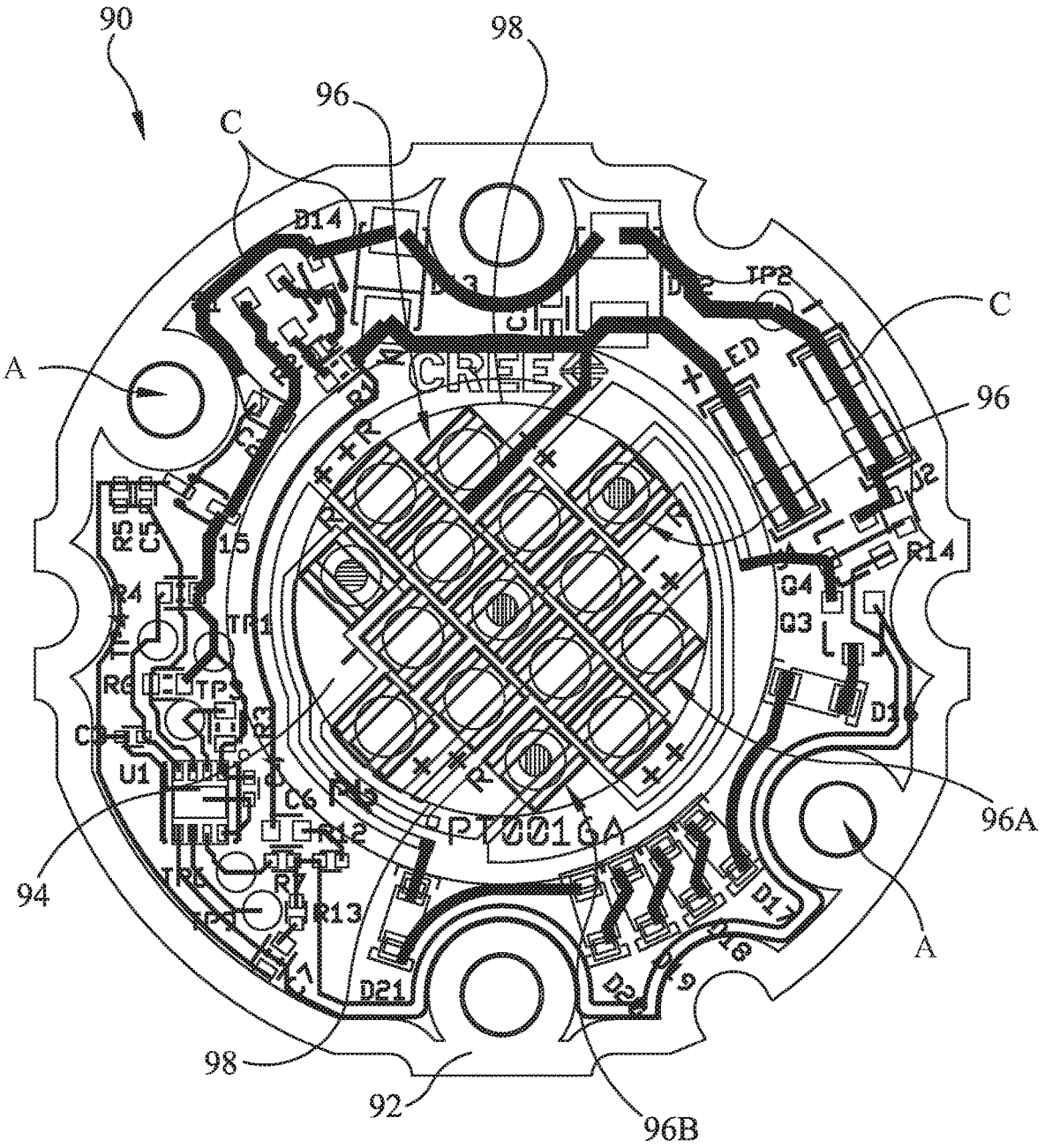
FIGS. 7A and 7B are top plan views of a solid state lighting apparatus or light emitter board.

Referring to FIG. 7A, a top plan view of a solid state lighting apparatus or light emitter board 90 is illustrated. For illustration purposes, the electrical connections and traces (e.g., including the black lines indicative of wires) are shown, however, portions of the connections and/or traces may be covered with a reflective material in a final form (see, e.g., FIG. 7B). Light emitter board 90 can comprise a substrate 92, which may support one or more electrical circuitry components (e.g., for driving solid state emitters), electrically conductive traces, one or more solid state emitters and/or emitter packages, rectifying circuitry components (e.g., where apparatus 90 is driven via AC), current diversion circuitry components, and/or current limiter circuitry components disposed or mounted thereon.

A plurality of electrical traces, generally designated 94, can be centrally disposed over substrate 92. Traces 94 can comprise a mounting area for one or more solid state light emitters, generally designated 96. A plurality of light emitters 96 (e.g., chips or packages) can be disposed over substrate 92 and electrically connected to each other in series and/or parallel via traces 94. Light emitters 96 can comprise one or more different colors (e.g., blue, green, red, BSY, RDO, etc.). In some aspects, at least some of the emitters 96 comprise BSY emitters or BSY packages 96A and at least some other emitters comprise RDO emitters or RDO packages 96B. For illustration purposes only, RDO emitters 96B are illustrated in hashed lines. Also, as described above a plurality of blue-shifted-yellow and/or blue-shifted-green LEDs as well as a plurality of blue-shifted-red LEDs may be used. Herein, the term "blue-shifted-yellow LED" refers to an LED that emits light in the blue color range that has an associated recipient luminophoric medium that includes phosphor(s) that receives the blue light emitted by the blue LED and in response thereto emits light having a peak wavelength in the yellow color range. A common example of a blue-shifted-yellow LED is a GaN-based blue LED that is coated or sprayed with a recipient luminophoric medium that includes a YAG:Ce phosphor. Similarly, as used herein the term "blue-shifted-green LED" refers to an LED that emits light in the blue color range that has an associated recipient luminophoric medium that includes phosphor(s) that receives the blue light emitted by the blue LED and in response thereto emits light having a peak wavelength in the green color range, and the term "blue-shifted-red LED" refers to an LED that emits light in the blue color range that has an associated recipient luminophoric medium that includes phosphor(s) that receives the blue light emitted by the blue LED and in response thereto emits light having a peak wavelength in the red color range. In some cases, a recipient luminophoric medium that is associated with a blue LED may include, for example, both green and yellow phosphors. In such a case, if the peak wavelength of the combined light output by the green and yellow phosphors is in the yellow color range, the LED is considered to be a blue-shifted-yellow LED, whereas if the peak wavelength of the combined light output by the green and yellow phosphors is in the green color range, the LED is considered to be a blue-shifted-green LED. In accordance with the disclosure herein, at least one or more LED(s) of each of the different colors can be used. In some aspects, only two LEDS can be used where each LED is of a different color, such as for example at least one blue shifted yellow (BSY) and at least one blue shifted red (BSR).

In some aspects, light emitters 96 are disposed over a portion of substrate 92 that comprises a light emitter surface (LES) 98. LES 98 includes a portion of the substrate 92 over which one or more emitters 96 are disposed and occupy for emitting light. LES 98 can comprise any size (e.g., any length, width, and/or diameter) portion of substrate 92. LES 98 is a surface from which light is emitted by one or more emitters 96, and may correspond in size to a portion of substrate 92 over which the emitters 96 are mounted.

One or more holes, openings, or apertures A may be provided in portions of substrate 92 so that board 90 may be affixed within a lighting component, product, bulb, lamp, lighting fixture, or the like. In some aspects, light emitter board 90 comprises a lighting device that can be easily inserted within and/or removed from a lighting fixture or component. In some aspects, light emitter board 90 is modular and configured for providing a drop-in replacement solution for use in personal lighting components and/or industrial lighting components such as spot lighting, high-bay lighting, and/or low-bay lighting fixtures or components.

In some aspects, substrate 92 can comprise a printed circuit board (PCB), a metal core printed circuit board (MCPCB), a flexible printed circuit board, a dielectric laminate (e.g., FR-4 boards as known in the art), a ceramic based substrate, or any other suitable substrate for mounting LED chips and/or LED packages. In some aspects substrate 92 can comprise one or more materials arranged to provide desired electrical isolation and high thermal conductivity. For example, at least a portion of substrate 92 may comprise a dielectric to provide the desired electrical isolation between electrical traces and/or sets of solid state emitters. In some aspects, substrate 92 can comprise ceramic such as alumina ($Al_2O_3$), aluminum nitride (AlN), silicon carbide (SiC), or a plastic or polymeric material such as polyimide, polyester etc. In some aspects, substrate 92 comprises a flexible circuit board, which can allow the substrate to take a non-planar or curved shape allowing for providing directional light emission with the solid state emitters also being arranged in a non-planar manner.

In some aspects, at least a portion of substrate 92 can comprise a MCPCB, such as a "Thermal-Clad" (T-Clad) insulated substrate material, available from The Bergquist Company of Chanhassen, Minn. A "Thermal Clad" substrate may reduce thermal impedance and conduct heat more efficiently than standard circuit boards. In some aspects, a MCPCB can also comprise a base plate on the dielectric layer, opposite the light emitters, and can comprise traces 94 to assist in heat spreading. In some aspects, the base plate can comprise different material such as Cu, Al or AlN. The base plate can have different thicknesses, such an in the range of 50 μm to 200 μm (e.g., 75 μm, 100 μm, etc.).

Substrate 92 can comprise any size and/or shape. In some aspects, substrate 92 can comprise a substantially circular shaped board having an outer diameter $D_{OUTER}$ that is approximately 10 mm or more, approximately 12 mm or more, approximately 20 mm or more, approximately 25 mm or more, or more than approximately 30 mm in diameter. In an exemplary embodiment, substrate 92 has an outer diameter $D_{OUTER}$ of approximately 19 mm. Substrate 92 is not limited to a substantially circular shape (see e.g., FIG. 1B).

Still referring to FIG. 7A and in some aspects, substrate 92 supports one or more electrical components (e.g., rectifiers, resistors, capacitors, power chips, etc.) connected by one or more electrically conductive connectors C. Connectors C can comprise traces, vias, wires, or any other electrically conductive connector.

Figure 7B:
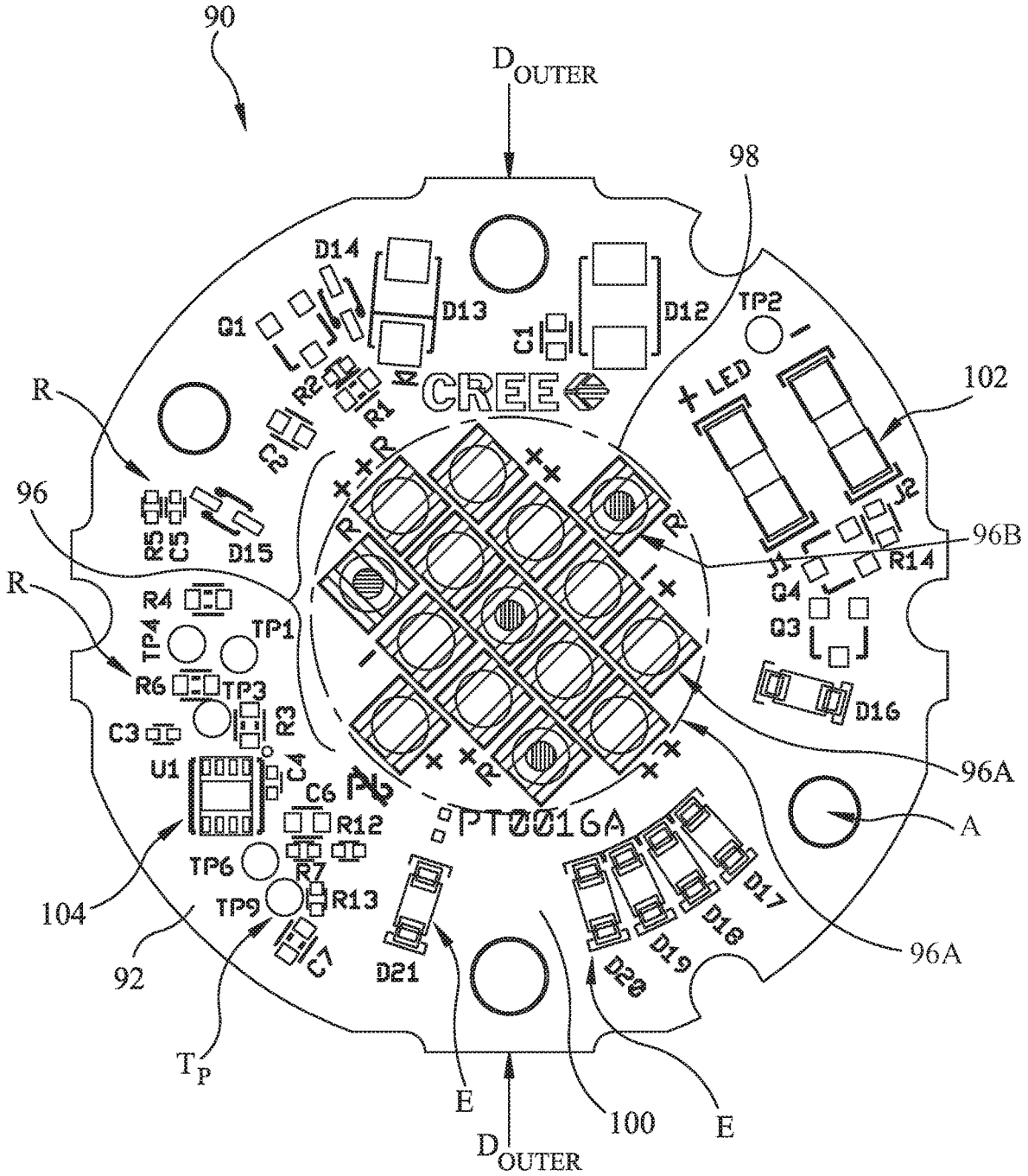

FIG. 7B is a top plan view of FIG. 7A, in which portions of individual traces 94 and connectors C have been covered by a reflective layer, cover, or overlay. For example, some portions of traces 94 are exposed for providing mounting pads for light emitters 96 to electrically and physically connect, for example, via solder, paste, epoxy, or other adhesive material. Other portions of traces 94 are disposed below and/or covered via a reflective overlay 100. Overlay 100 can comprise a white or silver plastic material, polymeric material, and/or a solder for improving reflectively of light and, therefore, light extraction and brightness per light emitter board 90.

Electrical power or signal passes into light emitter board 90 via terminals J1 and J2, also designated 102. Electrical wires (not shown) from a power source can be soldered, welded, crimped, glued, or otherwise electrically and physically attached or secured to terminals 102 for transmitting electrical current to light emitter board 90.

One or more electrical components, generally designated E, can be provided over and/or supported by substrate 92. Electrical components E can comprise various optional electrical components such as rectifying diode bridges, Zener or Schottky diodes, capacitors, etc., which are configured to rectify current, drive current into light emitters, limit current supplied to one or more light emitters, bypass or shunt emitters, and/or provide protection of emitters from electrostatic discharge events or voltage spikes.

Electrical components E can also comprise a plurality of resistors, generally designated R, supported on/over substrate 92 for can also be disposed for adjusting the amount of current supplied to light emitters. For example, at high temperatures, it may be desirable to boost the amount of current passing through some light emitters (e.g., red light emitters) and/or limit the amount of current passing through other light emitters (e.g., blue light emitters). Resistors R can comprise a resistor network for adjusting the amount of current supplied to one or more light emitters and/or one or more strings of light emitters, as needed.

Still referring to FIG. 7B and in some aspects, light emitter board 90 further comprises one or more optional signal conditioners U1, also designated 104, for controlling the amount of current that passes into light emitters and/or strings of light emitters for maintaining a desired color point and emission. Light emitter board 90 can comprise various electrical components configured to supply current to light emitters for maintaining a desired color point and/or emission not limited to diodes, resistors, transistors, signal conditioners (e.g., amplifiers), switches, capacitors (e.g., which can store and release current), and/or a microcontroller, where desired, to control an amount of current supplied to light emitters. Electrical aspects or properties associated with light emitter board 90 can be tested prior to use and/or incorporation within a lighting component by probing or testing light emitter board 90 via probing exposed test points TP that are connected to various light emitter and/or circuitry components.

As FIG. 7B further illustrates, two or more different types of LED packages can be, but do not have to be, provided and used within light emitter board 90 for obtaining desired light emissions and optical properties. For example, at least a first type of package 96A and at least a second type of package 96B can be provided over and/or on light emitter board 90. In some aspects, the first type of package 96A comprises a BSY package, and the second type of package 96B comprises an RDO package. For example and in some aspects, at least four RDO packages 96B are provided and at least 11

BSY packages 96A are provided. Any number and/or color of packages may be provided per light emitter board 90.

In some aspects, packages 96A and 96B are serially connected in one or more strings. Packages 96A and 96B can be arranged in a plurality of serially connected sets, parallel-connected sets, multiple mutually exclusive sets, and/or combinations thereof. The different packages 96A and 96B can comprise differently colored LED chips and can be intermixed in a uniform or non-uniform arrangement about a center point for improved color mixing and improved color rendering. Although different types/color of LED packages are shown for illustration purposes, a single type/color of LED package and/or more than two different types/colors of LED packages can be provided per light emitter board 90.

Packages 96A and/or 96B can utilize LED chips of any color, number, size, and/or shape. For example, each package packages 96A and/or 96B can comprise a single LED chip, or multiple LED chips. LED packages 96A and/or 96B can be configured to emit red, amber, orange, yellow, green, cyan, blue, and/or UV light. Light emitter board 90 can be disposed within and/or used for emitting light from a solid state component such as any of the ones illustrated herein; the component can comprise a located diffuser and/or focusing optic for providing a desired beam size and color. As described herein, a plurality of blue-shifted-yellow and/or blue-shifted-green LEDs as well as a plurality of blue-shifted-red LEDs may be used. Herein, the term "blue-shifted-yellow LED" refers to an LED that emits light in the blue color range that has an associated recipient luminophoric medium that includes phosphor(s) that receives the blue light emitted by the blue LED and in response thereto emits light having a peak wavelength in the yellow color range. A common example of a blue-shifted-yellow LED is a GaN-based blue LED that is coated or sprayed with a recipient luminophoric medium that includes a YAG:Ce phosphor. Similarly, as used herein the term "blue-shifted-green LED" refers to an LED that emits light in the blue color range that has an associated recipient luminophoric medium that includes phosphor(s) that receives the blue light emitted by the blue LED and in response thereto emits light having a peak wavelength in the green color range, and the term "blue-shifted-red LED" refers to an LED that emits light in the blue color range that has an associated recipient luminophoric medium that includes phosphor(s) that receives the blue light emitted by the blue LED and in response thereto emits light having a peak wavelength in the red color range. In some cases, a recipient luminophoric medium that is associated with a blue LED may include, for example, both green and yellow phosphors. In such a case, if the peak wavelength of the combined light output by the green and yellow phosphors is in the yellow color range, the LED is considered to be a blue-shifted-yellow LED, whereas if the peak wavelength of the combined light output by the green and yellow phosphors is in the green color range, the LED is considered to be a blue-shifted-green LED. In accordance with the disclosure herein, at least one or more LED(s) of each of the different colors can be used. In some aspects, only two LEDS can be used where each LED is of a different color, such as for example at least one blue shifted yellow (BSY) and at least one blue shifted red (BSR).

FIGS. 7A and 7B are an exemplary embodiment of one light emitter board 90 only, and should not be limited to the illustrated size, shape, number of LED chips/packages, and/or color of LED chips/packages shown thereon. In some embodiments, all packages may include a same (single) color of LED chip. In other embodiments, as shown, light emitter board 90 may include differently colored LED chips (e.g., 96A and/or 96B).

A solid state lighting component is therefore provided with an unmatched combination of high lumen output, high efficacy and high CRI with a small light source that meets and surpasses the features and benefits of CDMH lighting without any of its disadvantages so that there is no longer any need for compromise between performance and light quality.

FIGS. 8 through 10B are various views of different embodiments of solid state lighting components according to some aspects. Notably, optical properties associated with each lighting component in FIGS. 8 through 10B incorporate at least one light emitter board B, for example, which may include board 90 as shown and described in FIGS. 7A and 7B. Components in FIGS. 8 through 10B are improved via the use of one or more light directing or focusing structures or optics (e.g., reflectors, lenses, optionally textured optical elements, or the like), either alone or in combination with one or more light diffusers (e.g., diffusing components or elements) disposed at various locations with respect to board B. Optics, including but not limited to reflectors and diffusers, can be positioned at various positions or locations with respect to board B for providing components that have an improved central spot light, an improved center beam candlepower, an improved color rendering, improved color mixing, an improved (tighter) color uniformity, and/or a more desirable intensity profile.

Figure 8:
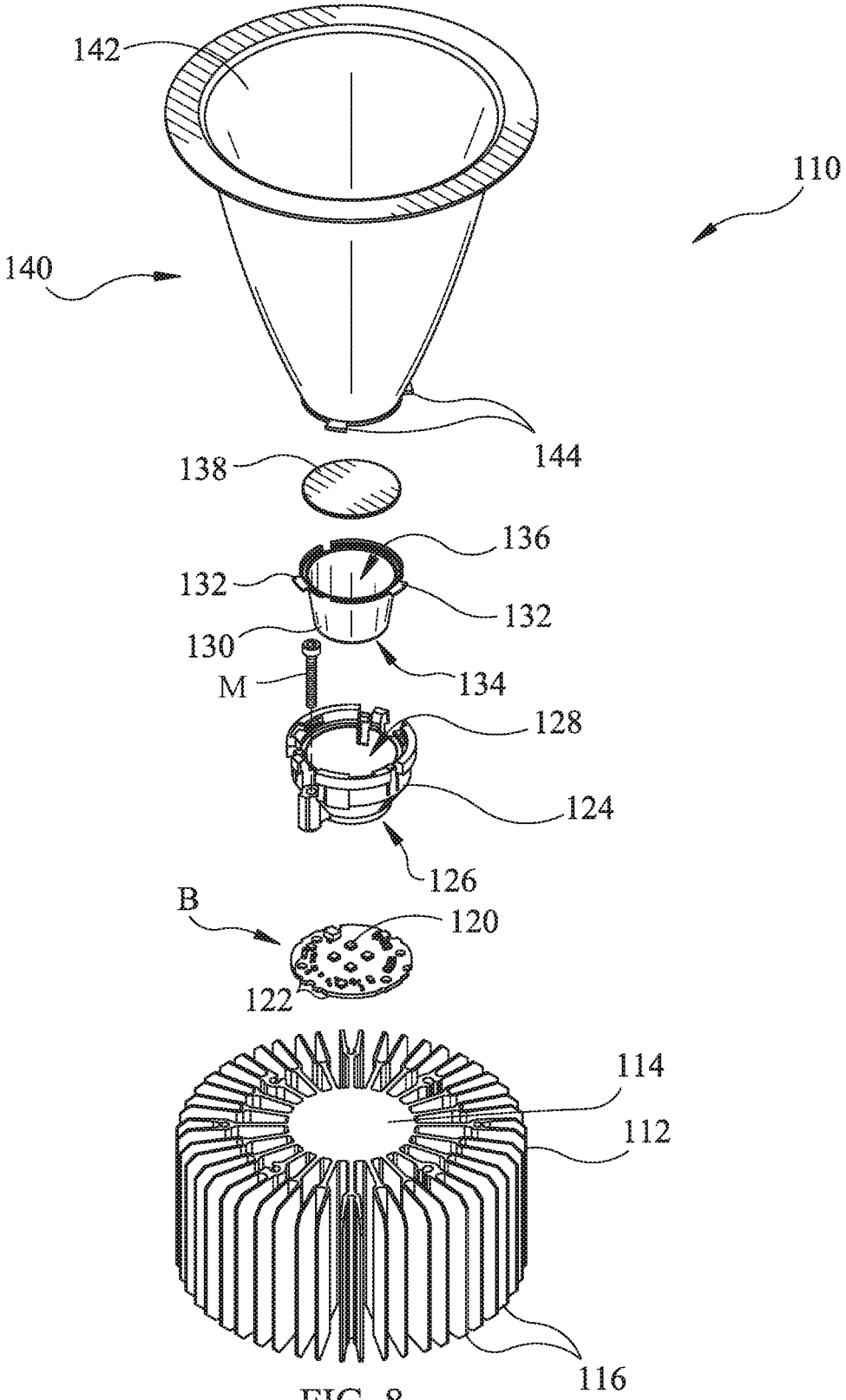
FIG. 8 is an exploded view of a solid state lighting component according to some aspects.

Referring now to FIG. 8, an exploded view of a solid state lighting component, generally designated 110, is shown and described. In some aspects, board B can be disposed over, mounted to, and/or otherwise supported by a heatsink 112. Board B can comprise one or more light emitters 120 (e.g., chips or packages) disposed over a surface thereof. In some aspects, light emitters 120 are disposed over a portion of a board substrate 122 defining a LES (e.g., 98, FIGS. 7A and 7B).

Heatsink 112 can comprise any suitable material (e.g., a metal, ceramic, a heat-sinking composite material, or the like) that is thermally conductive. Heatsink 112 is configured to dissipate heat that is generated by emitter chips or packages mounted on or over board B. In some embodiments, heatsink 112 comprises a substantially planar mounting surface 114 to which board B attaches. A thermally conductive material (not shown) can optionally be disposed between mounting surface 114 of heatsink 112 and portions of board B. Where used, the thermally conductive material (not shown) can comprise a thermally conductive paste, a thermally conductive adhesive, or the like. In some embodiments, heatsink 112 comprises a plurality of fins 116 that radiate outwardly from mounting surface 114. Fins 116 are configured to dissipate heat (e.g., generated by board B) into the surrounding air.

Component 110 can further comprise an optional base or housing structure 124. Housing structure 124 is configured to retain one or more optics. In some embodiments, housing structure 124 is configured to fasten or attach to heatsink 112 via one or more fastening members M (e.g., screws, bolts, pins, or the like) received in an aperture of housing structure 124.

In some embodiments, housing structure 124 comprises a lower portion 126 that is configured to mount on or over portions of board B. In some embodiments, lower portion 126 is disposed outside of the light emitter surface (e.g., outside of LES 98, FIG. 7A), which is occupied by light emitters 120. Housing structure 124 can further comprising a bore, aperture, or opening 128 that is configured to retain one or more optics. In some embodiments, a color mixing optic 130 is received in a portion of housing structure 124. Color mixing optic 130 can comprise a cylindrical tube, spacer, or mixing chamber 136 having a given height for mixing the light emitted by multiple light emitters 120. Thus, optic 130 mixes incoming light so that the resultant light has a substantially uniform color. In some embodiments, color mixing optic 130 is a white optic that is a diffusing optic configured to diffuse and/or mix light. Notably, optic 130 can assist in pre-mixing and pre-diffusing light before the light passes to the reflector.

In some embodiments, color mixing optic 130 can comprise one or more tabs or protrusions 132 disposed about a perimeter of a first portion that opposes a second, lower portion 134. Lower portion 134 is configured to mount on or over portions of board B outside of the light emitter surface (e.g., 98, FIG. 7A). In some aspects, color mixing optic 130 is lockable to or within housing structure 124 such as, for example, by virtue of the one or more protrusions 132. That is, protrusions 132 are configured to frictionally engage portions of housing structure 124 so that color mixing optic 130 is securely disposed therein. In some embodiments, color mixing optic 130 is a component configured to twist or rotate with respect to housing structure 124 for locking color mixing optic 130 to or within housing structure 124.

Still referring to FIG. 8 and in some embodiments, a diffuser 138 is provided on or over portions of color mixing optic 130. In some embodiments, diffuser 138 comprises a diffusing lens disposed at a top of mixing chamber 136 so that the light mixed in chamber 136 is diffused and output via diffuser 138. In some embodiments, diffuser 138 is spaced a distance away from the one or more light emitters 120. For example, component 110 can utilize a diffuser 138 that is spaced a distance away from one or more light emitters 120 for improving color mixing and color uniformity collectively emitted by differently colored light emitters 120 that are disposed on or over board B. Diffuser 138 can comprise any material, such as glass, plastic, a polymeric material, acrylic and/or any two- or three-dimensional structure not limited to a film, a disk, a sheet, a plate, a lens, a cone, a cover, a dome, a top-hat raised structure, or the like.

The light emitted by one or more light emitters 120 is pre-mixed and pre-diffused via optics (e.g., 130 and 138), and then emitted from component 110 via a light directing optic, such as a reflector 140. Reflector 140 can comprise any structure and/or material that is configured to reflect and/or focus light. Notably, component 110 first mixes the light via optics (e.g., 130, 138) and then shapes the light via reflector 140. The instant structure associated with the optics and the related methods results in a component 110 having improved light output, emission, color rendering, color mixing, and overall improved light extraction. Reflector 140 can comprise a film, a sheet, a cone, a plate, and/or a parabolic reflector having a reflective inner surface as illustrated. As will be appreciated by persons of skill in the art, any size, shape, and/or type reflector 140 can be provided. Reflector 140 can comprise a substantially smooth inner wall or reflective surface 142, a texturized inner wall or surface 142, or combinations thereof, depending upon the desired end-use and application. In some embodiments, color mixing optic 130 positions a diffusing optic (e.g., 138) between portions of reflective surface 142 and over the one or more light emitters 120, so that the diffuser 138 is positioned a distance away from the light emitter surface Notably, reflector 140 includes one or more tabs or protrusions 144. Protrusions are configured to frictionally engage and "lock" against portions of housing structure 124. In some embodiments, both optic 130 and reflector 140 are twistably or rotatably lockable to or within a component housing via tabs or protrusions. By virtue of protrusions 144, reflector 140 can be replaced or interchanged for a differently sized and/or shaped reflector, where desired. Reflector 140 can be diffusively reflective or specularly reflective, any size, shape, and/or type of reflector can be provided. The Illuminating Engineering Society (IES) published a Technical Memorandum, TM-30-15, entitled "IES Method for Evaluating Light Source Color Rendition". TM-30 relies on separate fidelity (RF) and gamut metrics (RF). Lighting components described herein are configured to output high fidelity, color mixed light. For example, lighting components described herein are configured to emit light having a fidelity index RF that is greater than 100 and a gamut index RG that is greater than 90.

In some embodiments, reflector 140, diffuser 138, optic 130, or portions thereof may be coated with a phosphor, thereby providing a remote phosphor component, where desired. In other embodiments, a separate two- or three-dimensional structure (e.g., plate, disk, film, a parabolic structure, or the like) is coated with phosphor provided over reflector 140, diffuser 138, or color mixing optic 130, and optionally mounted thereto.

In further embodiments, reflector 140 and/or component 110 is fitted with a secondary lens using total internal reflection (TIR) optics. Any type of secondary optics can be provided.

It will be appreciated that FIG. 8 is for illustrative purposes only and that various components, their locations, and/or their functions described above in relation to these figures may be changed, altered, added, or removed. For example, some components and/or functions (e.g., diffusers, reflectors, heatsink, etc.) may be separated into multiple entities and/or combined into a single entity where desired.

FIGS. 9A through 9D are various views of a solid state lighting component, generally designated 150, and portions thereof, according to some aspects. Component 150 is similar to component 110 shown in FIG. 8, and differs in regards to the placement of optics, including diffusers and/or reflectors.

Figure 9A:
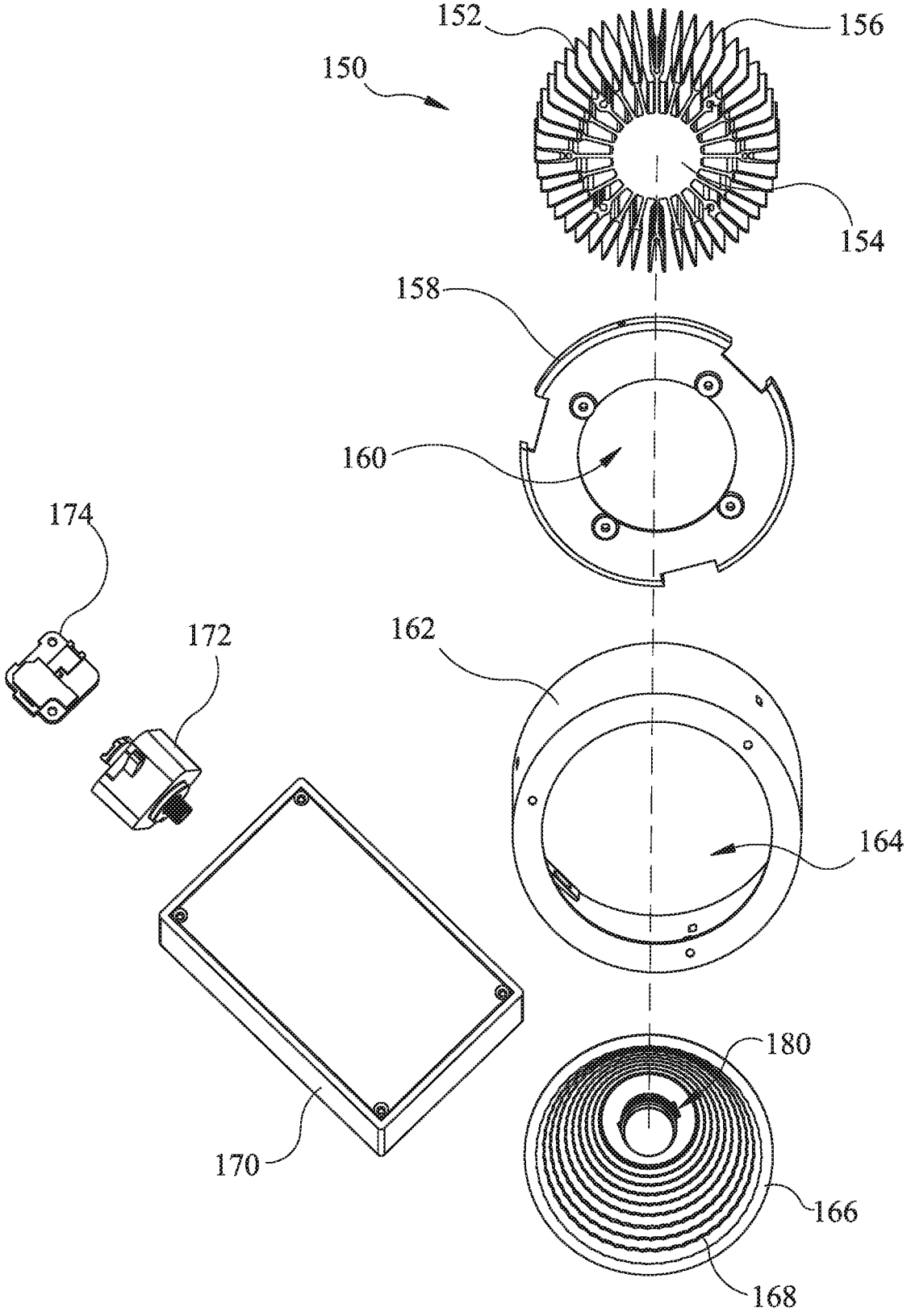
FIGS. 9A through 9D are various views of a solid state lighting component, and portions thereof, according to some aspects.

Referring now to FIG. 9A, lighting component 150 comprises a heatsink 152 having a mounting area 154 and a plurality of heat spreading structures, such as one or more fins 156 is provided. A retaining member 158 attaches heatsink 152 to a reflector housing 162. Retaining member 158 and reflector housing 162 each comprise respective apertures 160 and 162 such that a bottom planar surface of a board (e.g., B, FIG. 8) can attach directly to heatsink 152 for more effectively dissipating heat therefrom. In some embodiments, reflector housing 162 is configured to retain a reflector 166. The reflector 166 can affix or otherwise attach to reflector housing 162. In some embodiments, reflector 166 is configured to snap or press-fit against a portion of reflector housing 162 and attach thereto.

A light emitter portion 180 of component 150 is disposed within a lower portion of reflector 166. In some embodiments, light emitter portion 180 extends or projects from a lower surface of reflector 166. Reflector 166 can comprise a reflective surface that is disposed around one or light emitters (e.g., 184, FIG. 9B). The reflective surface of reflector 166 can comprise a smooth inner surface, or a texturized inner surface having a plurality of dimples, concavities, convexities, or facets 168. In some embodiments, component 150 comprises a plurality of facets 168 therein for improving the reflection and/or focus of light emitted by light emitter portion 180.

Component 150 further comprises a driving assembly configured to pass electrical current into the light emitter portion 180 for illuminating the same. The driving assembly includes a housing 170 that houses the electrical and driving components. Housing assembly 170 is configured to attach to portions of reflector housing 162 and/or retaining member 158. The driving assembly further comprises one or more adapters 172 and 174 for mounting or attaching component 150 a support structure (e.g., a beam, a wall, a ceiling, or the like).

Figure 9B:
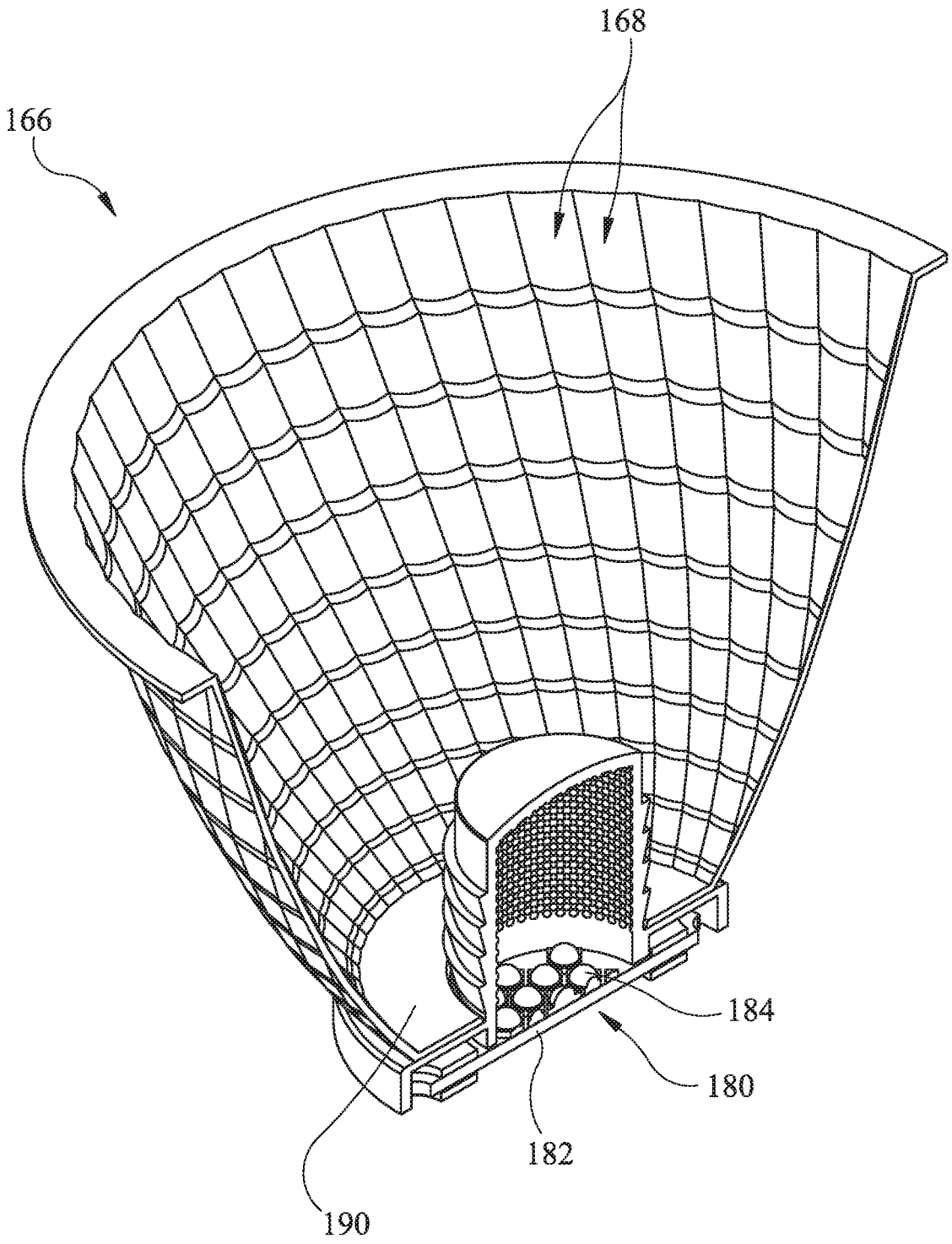

FIG. 9B is a detailed sectional view of light emitter portion 180 as it projects through a portion of reflector 166. Light emitter portion 180 comprises a substrate or board 182 over which a plurality of light emitters 184 are disposed. Light emitters 184 can comprise LED chips and/or packaged emitters. A diffusing optic 190 is disposed over and around the plurality of light emitters 184, which collectively occupy a portion of board 182 referred to as the LES. Notably, the diffusing optic 190 comprises a faceted or ridged outer surface for throwing diffused light at the reflector 166, and a texturized inner surface for improved color mixing. In some aspects, the texturized inner surface comprises a plurality of dimples. In some embodiments, reflector 166 is disposed around optic 190, light emitters 184 and surrounds a light emitter surface (e.g., surrounding a perimeter of the light emitter surface) occupied by light emitters 184 for focusing, directing, and/or reflecting light received from the light emitters 184.

Still referring to FIG. 9B and in some embodiments, diffusing optic 190 is retained by reflector 166 and disposed between portions of a reflective surface of reflector 166. Diffusing optic 190 is also disposed on or over the one or more light emitters 184, with portions of diffusing optic 190 being positioned a distance away from the light emitter surface of board 182 occupied by light emitters 184. Providing diffusing optic 190, or portions thereof, a distance away from light emitters 184 improves color mixing and uniformity. In further embodiments, reflector 166 and/or component 150 is fitted with an optional secondary lens using total internal reflection (TIR) optics. Any type of secondary optics can be provided over or around component 150.

Figure 9C:
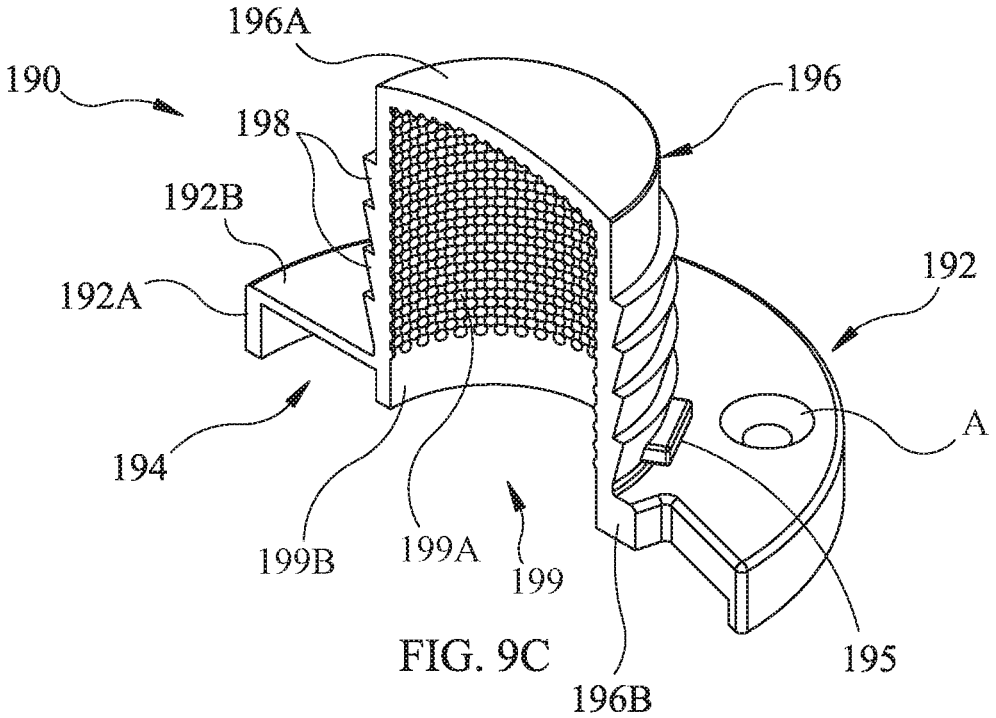
Figure 9D:
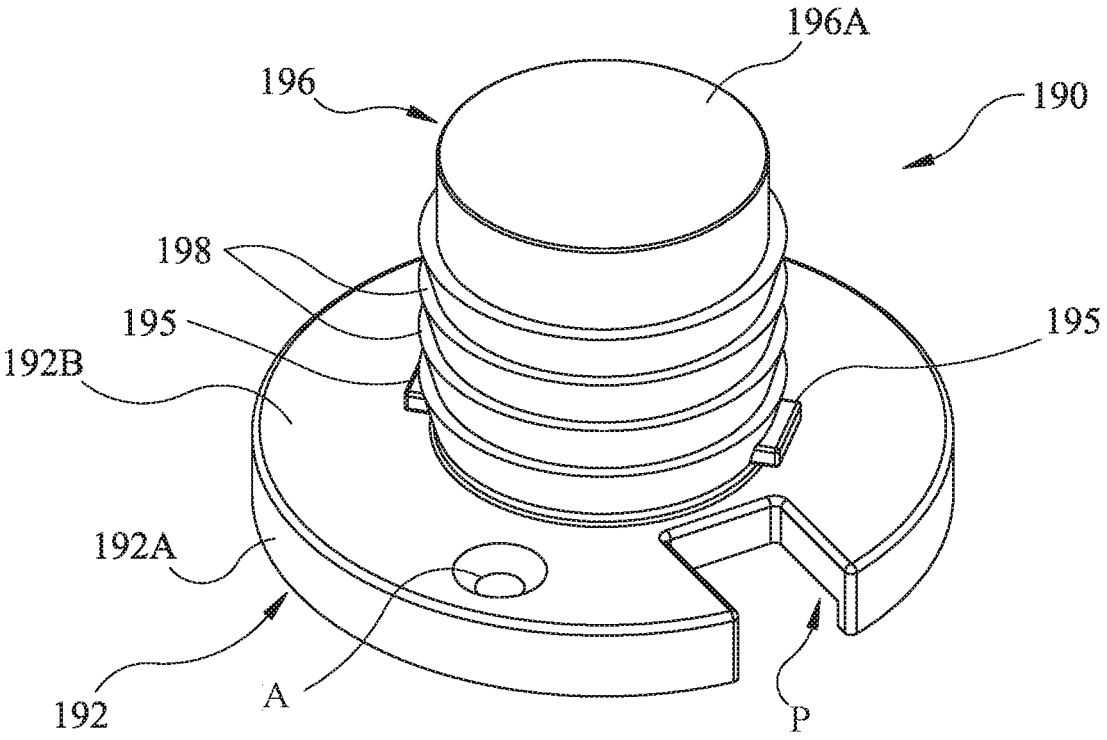

FIGS. 9C and 9D are respective sectional and perspective views of diffusing optic 190. Referring to FIG. 9C, it can be seen that optic 190 includes a lower body portion 192 having an outer wall 192A and a raised platform 192B. Outer wall 192A and platform 192B collectively form a passage or space 194 disposed in optic 190 for concealing electrical components supported on a perimeter or outer edges of a board or substrate that surround a light emitter surface (e.g., 98, FIG. 7A). Concealing the electrical components on a board reduces blockage or absorption of light.

Optic 190 further comprises a central body portion 196 disposed over, on, and/or above lower body portion 192. In some embodiments, central body portion 196 forms a diffusing or mixing chamber having a texturized inner surface 199A and a texturized outer surface comprising one or more facets 198. Facets 198 are configured to project or throw light at one or more desired angles towards the inner surface of reflector 166 (FIG. 9B). Diffused light is also emitted upwardly within reflector 166 from an upper surface 196A of central body portion 196.

Central body portion 196 defines an inner space or chamber 199 configured to surround a light emitter surface (e.g., a perimeter of a light emitter surface) of a board (e.g., 90, FIG. 7A) and diffuse light emitted by one or more light emitters. The texturized inner surface 199A of central body portion 196 is spaced apart from (e.g., above) a board (e.g., 90, FIG. 7A) via a spacer, ring, or light collecting region or portion 199B of optic 190. Light collecting portion 199B is configured to surround light emitters, collect light emitted by light emitters disposed on the board (e.g., 90, FIG. 7A) and reflect, cast, or otherwise project the light upwards towards the texturized surface 199A for improving color mixing and/or rendering. Light collecting portion 199B is shown as an integral portion of optic 190, however, a separate light collecting portion (e.g., a spacer, ring, or the like) can also be provided (see e.g., separate spacers or rings in FIGS. 3C and 10B). Optic 190 further comprises one or more outermost projections or tabs 195. Tabs 195 are configured to frictionally engage portions of reflector 166 to secure optic 180 thereto.

FIG. 9D is a perspective view of optic 190. A plurality of ridges or facets 198 are disposed around central body portion 196, and may be spaced apart or helically connected in a spiral. One or more openings, holes, or apertures A may also be disposed in lower body portion 192 for receiving connectors (e.g., screws, pins, or the like) therein to secure optic 190 to a heatsink (152, FIG. 9A). An opening region or passage P may also be disposed in lower body portion 192 thereby providing a conduit for electrical connectors or wires (not shown), which supply electrical current to light emitters 184 (FIG. 9B). 7

It will be appreciated that FIGS. 9A through 9D are for illustrative purposes only and that various components, their locations, and/or their functions described above in relation to these figures may be changed, altered, added, or removed. For example, some components and/or functions (e.g., diffusers, reflectors, heatsink, etc.) may be separated into multiple entities and/or combined into a single entity where desired.

Figure 10A:
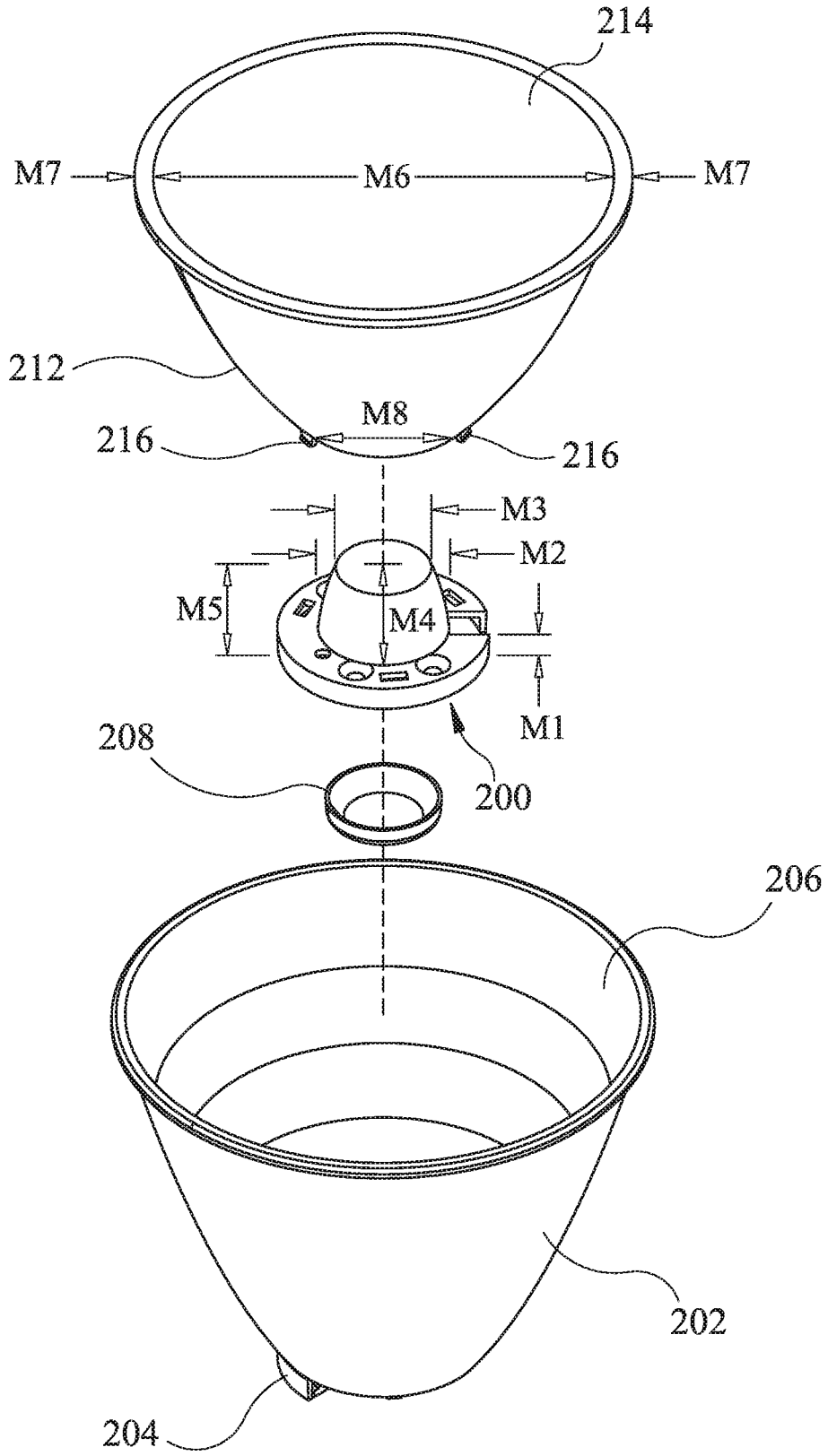
FIGS. 10A through 10C are various views of a solid state lighting component, and portions thereof, according to some aspects.
Figure 10B:
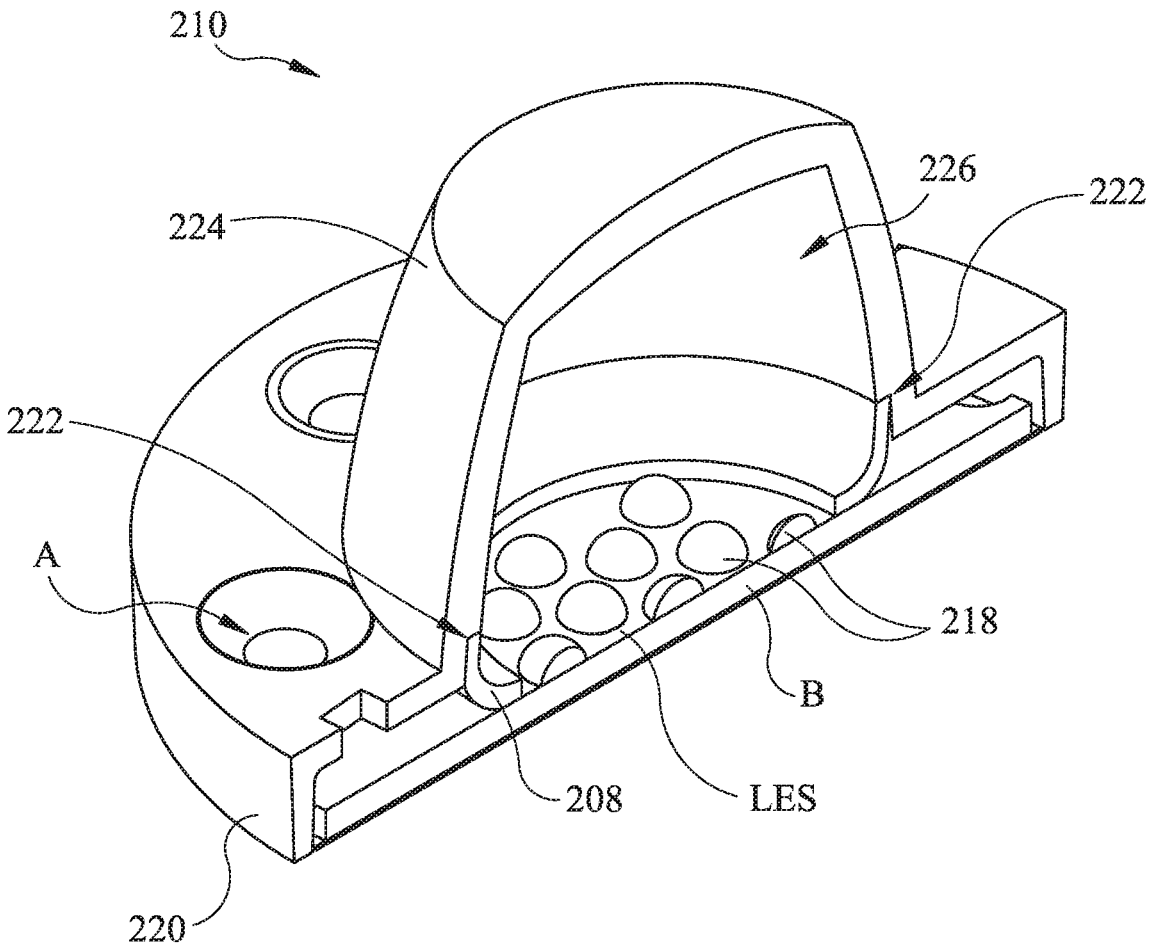
Figure 10C:
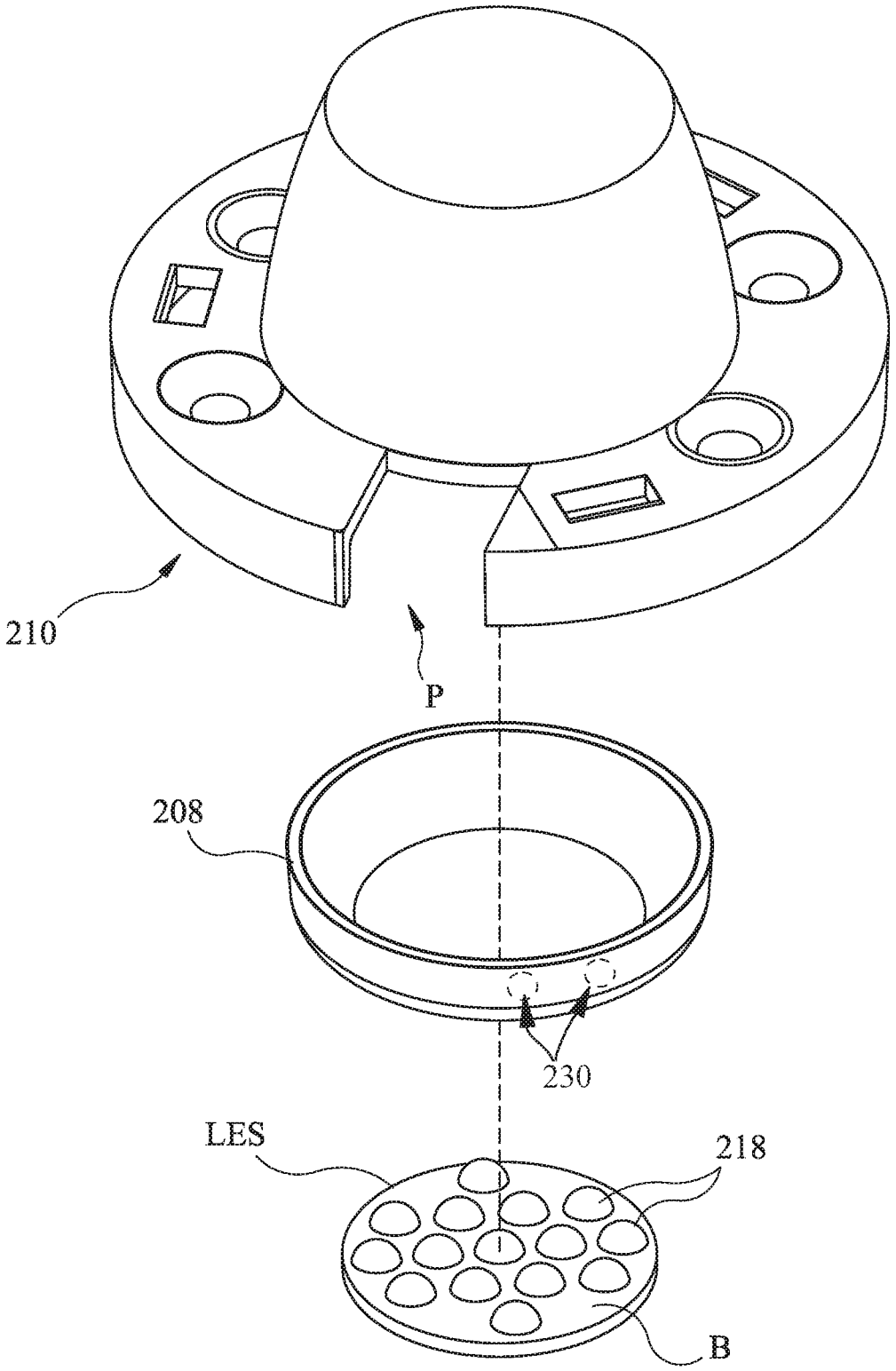

FIGS. 10A through 10C are various views of a solid state lighting component, generally designated 200, and portions thereof, according to some aspects. Component 200 is similar to component 150 shown in FIGS. 9A through 9D, and differs in regards to the spacing of and/or placement of respective optics, including diffusers and/or reflectors.

Referring now to FIG. 10A, lighting component 200 comprises a reflector housing 202 having one or more retaining structures 204 disposed about a lower perimeter thereof. Reflector housing 202 comprises an inner surface 206 configured to receive and support a light directing optic, such as a reflector 212. Reflector 212 comprises one or more tabs, protrusions 216, or the like disposed on or about a lower surface of reflector 212. Reflector 212 can be twist-locked to or within reflector housing 202 by virtue of protrusions 216, or portions thereof, being twisted or rotated until received and locked within retaining structures 204. Notably, reflector 212 is configured to quickly and easily attach and detach from reflector housing 202, thereby providing for interchangeable lighting components suitable for providing custom (desired) beam shapes, angles, or the like.

A light gathering (collecting) ring or spacer 208 is disposed at least partially within a portion of housing 202, and between portions of housing 202 and a diffusing optic 210. Spacer 208 can comprise a reflective material, such as a white reflective plastic material. In some embodiments, spacer 208 is disposed between portions of diffusing optic 210 and a planar upper light emitter surface (LES, FIG. 10B) or board (B, FIG. 10B), thereby locating diffusing optic 210 above and/or away from board (B, FIG. 10B). In some embodiments, spacer 208 comprises an annular body of material configured to fittingly engage diffusing optic 210. Spacer 208 is configured to direct light received from light emitters 218 (FIG. 10B) towards one or more inner surfaces of diffusing optic 210 thereby improving the mixing and diffusion of different colors of light received from different light emitters (e.g., BSY emitters, RDO emitters, or the like).

In some embodiments, diffusing optic 210 extends or projects from a lower surface of reflector 212 and reflector housing 202. Reflector 212 is a light directing optic having a reflective surface 214 that is disposed around one or light emitters (e.g., 218, FIG. 10B). Notably, diffusing optic 210 is centered with respect to the light directing optic (i.e., reflector 212). Reflective surface 214 of reflector 212 can comprise a smooth inner surface, or a texturized inner surface having a plurality of dimples, concavities, convexities, or facets. Any size, shape, and/or type of light directing optic can be used. Reflector 212 can optionally be fitted with a secondary optic (e.g., a TIR optic, not shown), where desired. Component 200 may further comprise a heat sink (not shown, see e.g., FIGS. 8 and 9A) for improving thermal management of the resultant component.

FIG. 10A further illustrates exemplary measurements. Notably, the combination of diffusing optic 210, emitter surface, reflector 212, and the board (e.g., B, FIG. 10B) results in a small form factor component that weighs less and has a smaller footprint than previously thought possible with surprising light output results and color mixing qualities that can match the light from a metal halide bulb even in a track lighting type form factor. The amount of light and the centered beam delivered by such a small form factor component (e.g., small in terms of height and diameter) that can compete with traditional metal halide components is quite unexpected. Diffusing optic 210 comprises an upper portion having a truncated cone shape with a rounded, concave top surface that sits on a substantially circular base (e.g., 220, FIG. 10B). FIG. 10A illustrates multiple exemplary measurements (e.g., M1 to M7) which are provided in Table 1 below.

TABLE 1

COMPONENT MEASUREMENTS

| Measurement ID (If Shown) | Description | Dimensions (mm) |
|---|---|---|
| M1 | Base (lower portion, 220) height of diffusing optic 210 | Min: <6 mm<br>Approx. Avg. 5.85 mm +/− 0.5 mm<br>Max: >6.5 mm |
| M2 | Outer diameter of the cone (central body portion 224), as measured at the base (e.g., 220) | Min: <30 mm<br>Approx. Avg. 28.2 mm +/− 3 mm<br>Max: >32 mm |
| M3 | Outer diameter of the cone (central body portion 224), as measured at the top | Min: <20 mm<br>Approx. Avg. 21.6 mm +/− 2 mm<br>Max: >24 mm |
| M4 | Overall cone height (e.g., 224, including rounded top surface) above base (e.g., 220) | Min: <20 mm<br>Approx. Avg. 20 mm +/− 2 mm<br>Max: >22 mm |
| M5 | Overall height of diffusing optic 210 | Min: <26 mm<br>Approx. Avg. 25.85 mm +/− 3 mm<br>Max: >30 mm |
| M6 | Inner diameter of reflector 212 as measured at the top | Min: <100 mm<br>Approx. Avg. 101.5 mm +/− 10 mm<br>Max: >112 mm |
| M7 | Outer diameter of reflector 212 as measured at the top | Min: <100 mm<br>Approx. Avg. 106.6 mm +/− 10 mm<br>Max: >120 mm |
| M8 | Outer diameter of reflector 212 as measured at the bottom | Min: <40 mm<br>Approx. Avg. 44.45 mm +/− 4 mm<br>Max: >50 mm |
| Reflector Height | Reflector 212 height above the diffusing optic base (e.g., 220, measurement of reflector sitting on the diffuser base) | Min: <60 mm<br>Approx. Avg. 64 mm +/− 6 mm<br>Max: >70 mm |
| Overall Height | Overall height of reflector 212 and diffusing optic 210 assembly (excluding any heat sink) | Min: <65 mm<br>Approx. Avg. 69.85 mm +/− 7 mm<br>Max: >78 mm |

FIGS. 10B and 10C are respective sectional and elevated views of diffusing optic 210 with respect to spacer 200 and light emitters 218 disposed over a board B. Referring to FIGS. 10B and 10C in general, a surface area of board B that is occupied by light emitters 218 defines a light emitter surface LES, which can have a width, diameter, and surface area. In some embodiments, spacer 208 is disposed around a perimeter of light emitter surface LES. Light emitters 218 can comprise LED chips and/or packaged emitters.

Diffusing optic 210 is disposed over and around the plurality of light emitters 218, and is spaces apart (separated) from emitter surface LES and board B via spacer 208. In some embodiments, diffusing optic 210 includes a recess 222 configured to receive portions of spacer 208. That is, diffusing optic 210 can be seated on and over portions of spacer 208.

In some embodiments, diffusing optic 210 comprises a lower body portion 220 and a central body portion 224. Central body portion 224 can extend a distance above lower body portion 220 thereby defining a substantially cylindrical or tubular light diffusing (e.g., light mixing) chamber 226. Inner and uppermost walls of diffusing chamber 226 are configured to diffuse light, the diffused light can then pass through the walls of diffusing chamber 226 and be directed via reflector 212 (FIG. 10A) for providing a desired beam size, shape, angle, or the like. In some aspects, diffusion optic 210 has a top-hat structure and shape that is configured to fit over portions of board B so that some portions of the optic are spaced a distance away from light emitters 218. In contrast to the embodiment in FIG. 9B, diffusing optic 210 includes a recess configure to retain a discrete spacer 208 (i.e., non-integral spacer) for directing light into chamber 226. Reflector 212 (FIG. 10A) is disposed around optic 210, light emitters 218, and surrounds a light emitter surface LES occupied by light emitters 218 for focusing, directing, and/or reflecting light received from the light emitters 218.

Providing diffusing optic 210, or portions thereof, a distance away from light emitters 218 improves color mixing and uniformity. Diffusing optic 210 includes one or more apertures A (FIG. 10B) configured to receive a mechanical fastener (e.g., a screw, pin, or the like). The mechanical fastener (not shown) can secure diffusing optic 210 to a heatsink (not shown). An opening region or passage P (FIG. 10C) may also be disposed in lower body portion 220 of optic 210 thereby providing a conduit for electrical connectors or wires (not shown), which supply electrical current to light emitters 218. As seen in FIG. 10C, spacer 208 can further comprise one or more optional openings, slots, or vents generally designated 230 that can be configured in any suitable configuration to dissipate heat. Vents 230 are shown in broken lines as they are optional, and can have any size, shape, and be provided in any quantity. Notably, diffusing optics as described herein are configured to fully pre-mix and/or pre-diffuse all of the light, prior to the light encountering the reflective surface of the respective reflector.

According to the disclosure herein, a powerful, centered light beam comprising a color rendering index (CRI) of approximately 80 CRI or more is provided that utilizes at least two LEDs (LED chips or packages) of different colors, and matches the light output of a metal-halide bulb.

It will be appreciated that FIGS. 10A through 10C are for illustrative purposes only and that various components, their locations, and/or their functions described above in relation to these figures may be changed, altered, added, or removed. For example, some components and/or functions (e.g., diffusers, reflectors, spacer, etc.) may be separated into multiple entities and/or combined into a single entity where desired.

While the subject matter has been has been described herein in reference to specific aspects, features, and illustrative embodiments, it will be appreciated that the utility of the subject matter is not thus limited, but rather extends to and encompasses numerous other variations, modifications and alternative embodiments, as will suggest themselves to those of ordinary skill in the field of the present subject matter, based on the disclosure herein.

Aspects disclosed herein can, for example and without limitation, provide one or more of the following beneficial technical effects: improved efficiency; improved color rendering; improved (tighter) color uniformity; minimized losses in luminous flux, improved centralized hot spot, improved fidelity index, improved gamut index, and/or improved beam angle.

Various combinations and sub-combinations of the structures and features described herein are contemplated and will be apparent to a skilled person having knowledge of this disclosure. Any of the various features and elements as disclosed herein can be combined with one or more other disclosed features and elements unless indicated to the contrary herein. Correspondingly, the subject matter as hereinafter claimed is intended to be broadly construed and interpreted, as including all such variations, modifications and alternative embodiments, within its scope and including equivalents of the claims.

What is claimed is:

1. A solid state lighting component comprising:

a substrate;

one or more light emitters disposed over the substrate, wherein a surface area of the substrate that is occupied by the one or more light emitters defines a light emitter surface;

a light directing optic comprising a reflective surface disposed around the light emitter surface;

a diffusing optic disposed between portions of the light directing optic and over the one or more light emitters; and a hollow region over the substrate, such that at least a portion of the diffusing optic is spaced a distance away from the light emitter surface;

wherein the hollow region comprises a hollow spacer, which comprises a color mixing chamber.

2. The component of claim 1, wherein the distance is greater than one-half of a width of the light emitter surface.

3. The component of claim 1, wherein the light directing optic comprises a reflector, and wherein the reflector is configured to provide light having a beam angle that is between approximately 20° and 30°.

4. The component of claim 1, wherein the reflective surface is texturized.

5. The component of claim 1, wherein the diffusing optic comprises a film, a disk, a sheet, a plate, a lens, a cone, a cover, a dome, or a three-dimensional structure having one or more walls.

6. The component of claim 1, wherein the diffusing optic is twist or rotatably lockable to or within a component housing.

7. The component of claim 1, wherein the color mixing chamber has a texturized inner surface.

8. The component of claim 1, wherein the color mixing chamber is integrally formed with the diffusing optic.

9. The component of claim 1, wherein the color mixing chamber comprises one or more vents for dissipating heat.

10. The component of claim 1, wherein the color mixing chamber has an outer surface comprising one or more facets.

11. The component of claim 1, wherein the hollow spacer is positioned between the light directing optic and the diffusing optic.

12. The component of claim 1, wherein the light directing optic comprises a frustoconically shaped inner profile and wherein the diffusing optic comprises a domed shape.

13. The component of claim 12, wherein the diffusing optic is only connected to the light directing optic.

14. A solid state lighting component comprising:

a substrate;

at least two light emitters disposed over the substrate, wherein a surface area of the substrate that is occupied by the one or more at least two light emitters defines a light emitter surface, and wherein a first light emitter of the at least two light emitters is configured to emit a first color of light, and a second light emitter of the at least two light emitters is configured to emit a second color of light;

a diffusing optic disposed over the at least two light emitters; and a light directing optic configured for receiving and reflecting light that passes through the diffusing optic;

wherein the light directing optic is mounted to the solid state lighting component by attachment to the diffusing optic.

15. The component of claim 14, wherein the solid state lighting component is configured to provide light with a beam angle of approximately 15° or more, approximately 20° or more, approximately 25° or more, approximately 30° or more, approximately 40° or more, or approximately 60° or more.

16. The component of claim 14, wherein the component is configured to output a centered light beam that comprises a color rendering index (CRI) of approximately 80 CRI or more.

17. The component of claim 14, wherein the diffusing optic is coaxially disposed with respect to the light directing optic.

18. The component of claim 14, wherein the first color is primarily blue and the second color is primarily red.

19. The component of claim 14, wherein the component is operable to output at least approximately 90 lumens per watt (LPW) or more at 30 Watts (W).

20. The component of claim 14, wherein the component is operable to output at least approximately 120 lumens per watt (LPW) or more at 30 Watts (W).

21. The component of claim 14, wherein the component is operable to output at least approximately 140 lumens per watt (LPW) or more at 30 Watts (W).

22. The component of claim 14, wherein a centered beam candlepower is approximately 14,000 candela.

23. The component of claim 14, wherein the diffusing optic comprises a substantially planar surface.

24. A solid state lighting component comprising:

a substrate;

one or more light emitters disposed over the substrate, wherein a surface area of the substrate that is occupied by the one or more light emitters defines a light emitter surface;

a light directing optic comprising a reflective surface disposed around the light emitter surface;

a diffusing optic, which is only connected to the light directing optic and is disposed between portions of the light directing optic and over the one or more light emitters; and a hollow region over the substrate, such that at least a portion of the diffusing optic is spaced a distance away from the light emitter surface.

* * * * *